US011037498B2

(12) United States Patent
Seo et al.

(10) Patent No.: US 11,037,498 B2
(45) Date of Patent: Jun. 15, 2021

(54) DISPLAY APPARATUS AND METHOD OF DRIVING THE SAME

(71) Applicant: SAMSUNG DISPLAY CO., LTD., Yongin-si (KR)

(72) Inventors: Hae-Kwan Seo, Hwaseong-si (KR); Wontae Kim, Hwaseong-si (KR); Sunghoon Bang, Seoul (KR); Taehoon Kim, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/880,655

(22) Filed: May 21, 2020

(65) Prior Publication Data

US 2020/0402464 A1 Dec. 24, 2020

(30) Foreign Application Priority Data

Jun. 18, 2019 (KR) ..... 10-2019-0072478

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0426* (2013.01); *G09G 2330/021* (2013.01); *G09G 2380/02* (2013.01)

(58) Field of Classification Search
CPC ... G06F 1/1652; G06F 1/1641; G09G 3/3225; G09G 3/3266; G09G 2310/0221; G09G 2330/021; G09G 2340/04; G09G 2340/0442; G09G 2380/02; H01L 27/3244; H01L 27/3276; H01L 51/0097; H01L 2251/5338; Y02E 10/549
See application file for complete search history.

(56) References Cited

U.S. PATENT DOCUMENTS 9,830,855 B1 * 11/2017 Li ..... G09G 3/3266
2014/0028659 A1 * 1/2014 Yamazaki ..... G11C 19/28 345/213
2016/0313769 A1 * 10/2016 Yoshitani ..... G04G 21/04

FOREIGN PATENT DOCUMENTS

KR 10-2016-0108705 9/2016
KR 10-2017-0137632 12/2017
KR 10-2018-0135434 12/2017
KR 10-1910111 10/2018

* cited by examiner

*Primary Examiner* — Nelson M Rosario
(74) *Attorney, Agent, or Firm* — F. Chau & Associates, LLC

(57) ABSTRACT

A display apparatus includes a display panel, a power voltage generator, a gate driver and a data driver. The display panel includes first and second display areas, a first back gate signal applying line connected to at least one back gate electrode of at least one of a plurality of pixels in the first display area and a second back gate signal applying line connected to at least one back gate electrode of at least one of a plurality of pixels in the second display area. The power voltage generator is configured to output a first back gate signal to the first back gate signal applying line and a second back gate signal to the second back gate signal applying line. The gate driver is configured to output a gate signal to the display panel. The data driver is configured to output a data voltage to the display panel.

19 Claims, 30 Drawing Sheets

DISPLAY APPARATUS AND METHOD OF DRIVING THE SAME

CROSS-REFERENCE TO RELATED APPLICATIONS

This application claims priority under 35 U.S.C. § 119 to Korean Patent Application No. 10-2019-0072478, filed on Jun. 18, 2019 in the Korean Intellectual Property Office, the disclosure of which is incorporated by reference herein in its entirety.

TECHNICAL FIELD

Exemplary embodiments of the present inventive concept relate to a display apparatus and a method of driving the display apparatus. More particularly, exemplary embodiments of the present inventive concept relate to a foldable display apparatus and a method of driving the display apparatus.

DISCUSSION OF THE RELATED ART

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

A foldable display apparatus having a flexible display panel may have at least two display areas. The display areas may be formed in a single flexible display panel.

One of the display areas may be an inactive area according to a folded status. For example, a display area that is not visible to the user when the foldable display apparatus is folded may correspond to the inactive area. A black image may be displayed in the inactive area. Although the black image is displayed in the inactive area, some amount of power may still be consumed.

SUMMARY

Exemplary embodiments of the present inventive concept provide a display apparatus capable of reducing power consumption of the display apparatus.

Exemplary embodiments of the present inventive concept also provide a method of driving the display apparatus.

In an exemplary embodiment of the present inventive concept, a display apparatus includes a display panel, a power voltage generator, a gate driver and a data driver. The display panel includes a first display area, a second display area, a first back gate signal applying line connected to at least one back gate electrode of at least one of a plurality of pixels in the first display area and a second back gate signal applying line connected to at least one back gate electrode of at least one of a plurality of pixels in the second display area. The power voltage generator is configured to output a first back gate signal to the first back gate signal applying line and a second back gate signal to the second back gate signal applying line. The gate driver is configured to output a gate signal to the display panel. The data driver is configured to output a data voltage to the display panel.

In an exemplary embodiment, the first display area and the second display area are configured to display an image in a normal driving mode. The first back gate signal is substantially the same as the second back gate signal in the normal driving mode.

In an exemplary embodiment, the first display area is configured to display an image and the second display area is configured not to display an image in a partial driving mode. The first back gate signal is different from the second back gate signal in the partial driving mode.

In an exemplary embodiment, the second back gate signal is greater than the first back gate signal in the partial driving mode.

In an exemplary embodiment, the display apparatus further includes an emission driver, and the second back gate signal is configured to increase from a normal level to an inactive level greater than the normal level when the display panel is folded. At least one of the gate driver, the data driver and the emission driver is configured not to output a driving signal to the second display area when the display panel is folded.

In an exemplary embodiment, a carry signal is not transmitted to a portion of the gate driver corresponding to the second display area so that the gate driver is configured not to output the gate signal to the second display area when the display panel is folded.

In an exemplary embodiment, an output buffer of the data driver is configured to be deactivated when outputting the data voltage to the second display area so that the data driver is configured not to output the data voltage to the second display area when the display panel is folded.

In an exemplary embodiment, the data driver is configured to output a black data voltage to the second display area when the display panel is folded.

In an exemplary embodiment, the second back gate signal is configured to decrease from the inactive level to the normal level when the display panel is changed from a folded state to an unfolded state.

In an exemplary embodiment, the data driver is configured to temporally output a black data voltage to the second display area when the display panel is changed from the folded state to the unfolded state.

In an exemplary embodiment, at least one of the pixels of the display panel includes a first pixel switching element including a control electrode connected to a first node, an input electrode connected to a second node and an output electrode connected to a third node. The at least one pixel further includes a second pixel switching element including a control electrode configured to receive a data write gate signal, an input electrode configured to receive the data voltage and an output electrode connected to the second node. The at least one pixel further includes a third pixel switching element including a control electrode configured to receive the data write gate signal, an input electrode connected to the first node and an output electrode connected to the third node. The at least one pixel further includes a fourth pixel switching element including a control electrode configured to receive a data initialization gate signal, an input electrode configured to receive an initialization voltage and an output electrode connected to the first node. The at least one pixel further includes a fifth pixel switching element including a control electrode configured to receive an emission signal, an input electrode configured to receive a high power voltage and an output electrode connected to the second node. The at least one pixel further includes a sixth pixel switching element including a control electrode configured to receive the emission signal, an input electrode connected to the third node and an output electrode connected to an anode electrode of an organic light emitting element. The at least one pixel further includes a seventh pixel switching element including a control electrode configured to receive an organic light emitting element initialization gate signal, an input electrode configured to receive the initialization voltage and an output electrode connected to the anode electrode of the organic light emitting element. The at least one pixel further includes a storage capacitor including a first electrode configured to receive the high power voltage and a second electrode connected to the first node. The at least one pixel further includes the organic light emitting element including the anode electrode and a cathode electrode configured to receive a low power voltage.

In an exemplary embodiment, the first pixel switching element further includes a back gate electrode configured to receive the first back gate signal or the second back gate signal.

In an exemplary embodiment, the sixth pixel switching element further includes a back gate electrode configured to receive the first back gate signal or the second back gate signal.

In an exemplary embodiment, the first pixel switching element further includes a first back gate electrode configured to receive the first back gate signal or the second back gate signal. The sixth pixel switching element further includes a second back gate electrode configured to receive the first back gate signal or the second back gate signal.

In an exemplary embodiment, at least one of the pixels of the display panel includes a first pixel switching element including a control electrode connected to a first node, an input electrode configured to receive a high power voltage and an output electrode connected to an anode electrode of an organic light emitting element. The at least one pixel further includes a second pixel switching element including a control electrode configured to receive the gate signal, an input electrode configured to receive the data voltage and an output electrode connected to the first node. The at least one pixel further includes a storage capacitor including a first electrode configured to receive the high power voltage and a second electrode connected to the first node. The at least one pixel further includes the organic light emitting element including the anode electrode and a cathode electrode configured to receive a low power voltage.

In an exemplary embodiment, the first pixel switching element further includes a first back gate electrode configured to receive the first back gate signal or the second back gate signal.

In an exemplary embodiment, the second pixel switching element further includes a second back gate electrode configured to receive the first back gate signal or the second back gate signal.

In an exemplary embodiment according to the present inventive concept, a method of driving a display apparatus includes outputting a first back gate signal to a first back gate signal applying line connected to at least one back gate electrode of at least one of a plurality of pixels in a first display area of a display panel, outputting a second back gate signal to a second back gate signal applying line connected to at least one back gate electrode of at least one of a plurality of pixels in a second display area of the display panel, outputting a gate signal to the display panel and outputting a data voltage to the display panel.

In an exemplary embodiment, the first display area and the second display area are configured to display an image in a normal driving mode. The first back gate signal is substantially the same as the second back gate signal in the normal driving mode. The first display area is configured to display an image and the second display area is configured not to display an image in a partial driving mode. The first back gate signal is different from the second back gate signal in the partial driving mode.

In an exemplary embodiment, the second back gate signal is configured to increase from a normal level to an inactive level greater than the normal level when the display panel is folded. At least one of the gate driver, the data driver and an emission driver is configured not to output a driving signal to the second display area when the display panel is folded. The second back gate signal is configured to decrease from the inactive level to the normal level when the display panel changes from a folded state to an unfolded state.

According to the display apparatus and the method of driving the display apparatus according to exemplary embodiments of the present inventive concept, independent back gate signals are applied to first back gate electrodes disposed in the first display area and second back gate electrodes disposed in the second display area so that the pixels in the inactive area may be controlled not to emit light. In addition, the gate driver does not output the gate signal to the inactive area, the data driver does not output the data voltage to the inactive area and/or the emission driver does not output the emission signal to the inactive area in a folded state of the display panel. Thus, the power consumption of the display apparatus may be reduced.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EXEMPLARY EMBODIMENTS

Figure 1:
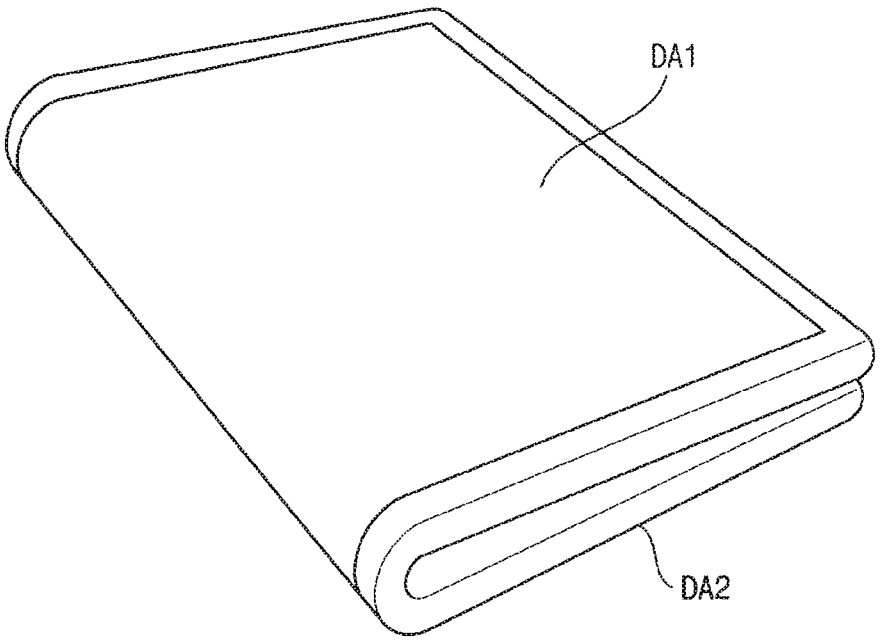
FIG. 1 is a perspective view illustrating a display apparatus according to an exemplary embodiment of the present inventive concept.

Exemplary embodiments of the present inventive concept will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

It should be understood that descriptions of features or aspects within each exemplary embodiment should typically be considered as available for other similar features or aspects in other exemplary embodiments, unless the context clearly indicates otherwise.

As used herein, the singular forms "a", "an" and "the" are intended to include the plural forms as well, unless the context clearly indicates otherwise.

Herein, when two or more elements or values, such as, e.g., two or more signals, are described as being substantially the same as or about equal to each other, it is to be understood that the elements or values are identical to each other, indistinguishable from each other, or distinguishable from each other but functionally the same as each other as would be understood by a person having ordinary skill in the art. For example, when two or more elements or values are substantially the same as or about equal to each other but are not identical to each other, it is to be understood that the two or more elements or values are approximately the same as or equal to each other within a measurement error as would be understood by a person having ordinary skill in the art.

Figure 2:
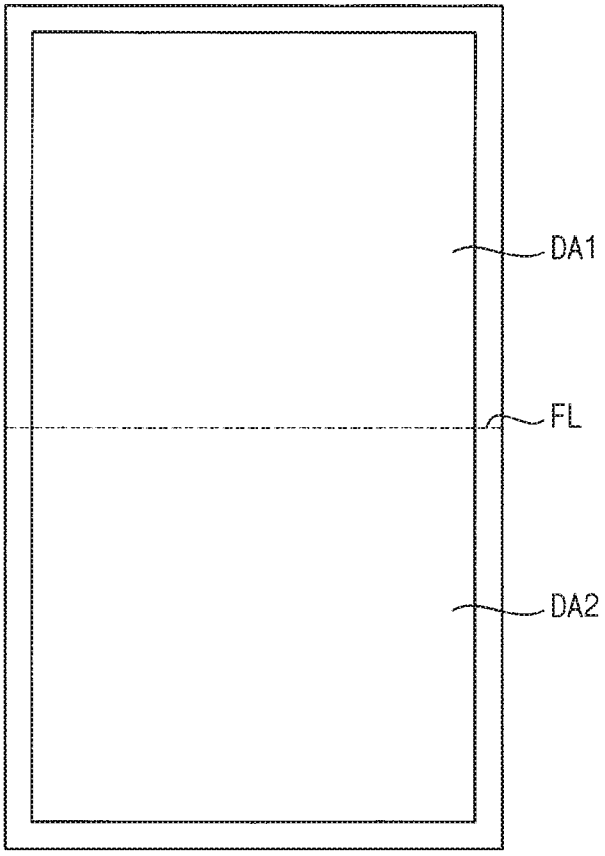
FIG. 2 is a plan view illustrating the display apparatus of FIG. 1.

FIG. 1 is a perspective view illustrating a display apparatus according to an exemplary embodiment of the present inventive concept. FIG. 2 is a plan view illustrating the display apparatus of FIG. 1.

Referring to FIGS. 1 and 2, the display apparatus may include a flexible display panel. The display apparatus may be a foldable display apparatus, and may be folded along a folding line FL.

The display apparatus may include a first display area DA1 disposed on a first side of the folding line FL and a second display area DA2 disposed on a second side of the folding line FL.

When the display apparatus is folded as shown in FIG. 1, the first display area DA1 may display an image and the second display area DA2 may not display an image. Alternatively, when the display apparatus is folded as shown in FIG. 1, the second display area DA2 may display an image and the first display area DA1 may not display an image according to a user setting.

Figure 3:
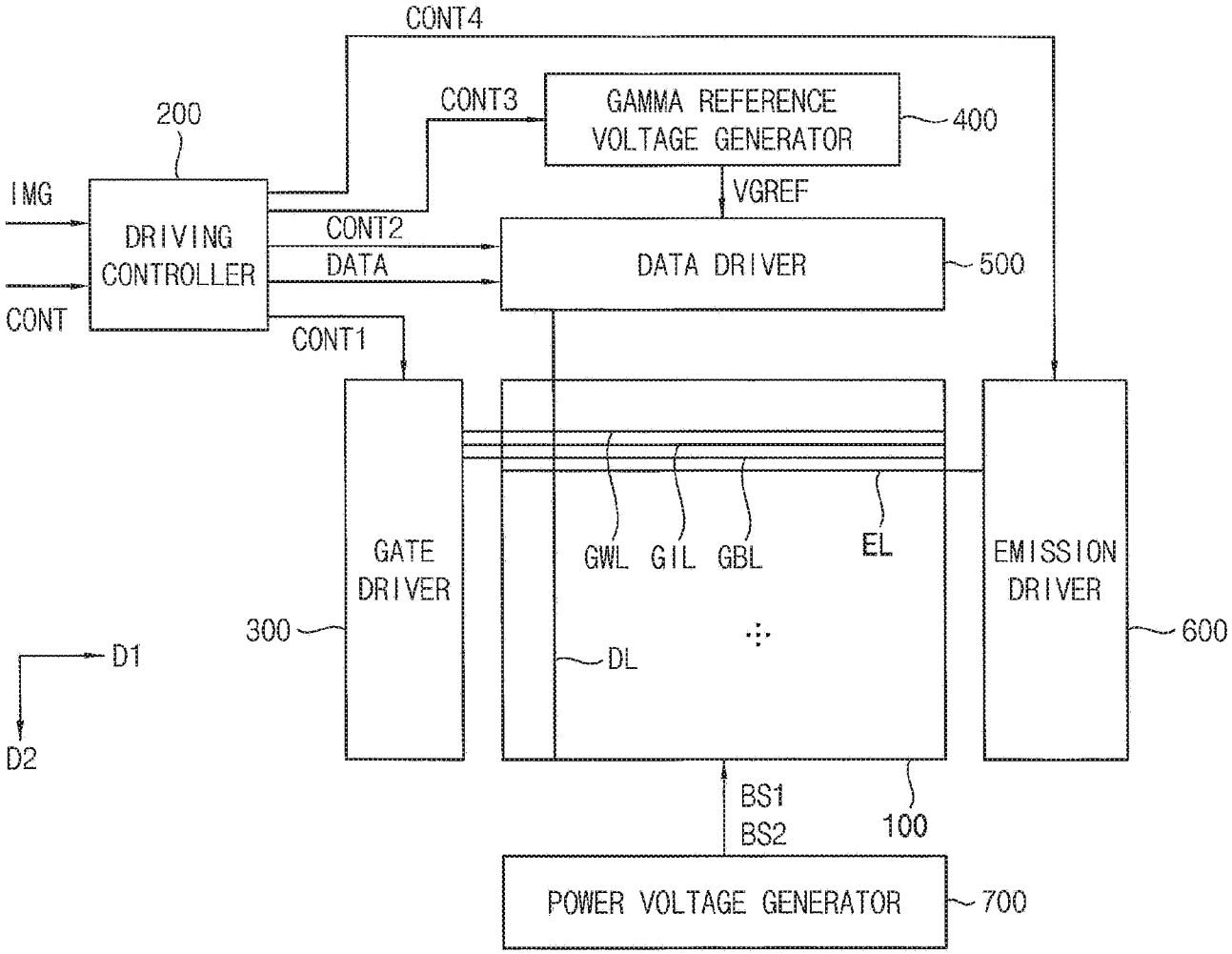
FIG. 3 is a block diagram illustrating the display apparatus of FIG. 1.

FIG. 3 is a block diagram illustrating the display apparatus of FIG. 1.

Referring to FIGS. 1 to 3, the display apparatus includes a display panel 100 and a display panel driver. The display panel driver includes a driving controller 200, a gate driver 300, a gamma reference voltage generator 400, a data driver 500, an emission driver 600 and a power voltage generator 700. The display panel driver may also be referred to herein as a display panel driver circuit, the driving controller 200 may also be referred to herein as a driving controller circuit, the gate driver 300 may also be referred to herein as a gate driver circuit, the gamma reference voltage generator 400 may also be referred to herein as a gamma reference voltage generator circuit, the data driver 500 may also be referred to herein as a data driver circuit, the emission driver 600 may also be referred to herein as an emission driver circuit and the power voltage generator 700 may also be referred to herein as a power voltage generator circuit.

The display panel 100 has a display region in which an image is displayed and a peripheral region adjacent to the display region.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. The gate lines GWL, GIL and GBL extend in a first direction D1, the data lines DL extend in a second direction D2 crossing the first direction D1 and the emission lines EL extend in the first direction D1.

In an exemplary embodiment, the display panel 100 may include the first display area DA1, the second display area DA2, a first back gate signal applying line connected to back gate electrodes of pixels in the first display area DA1 and a second back gate signal applying line connected to back gate electrodes of pixels in the second display area DA2. The first back gate signal applying line and the second back gate signal applying line are utilized to allow for different portions of the display panel 100 to be activated (e.g., emit light via pixels) and to be deactivated (e.g., not emit light via pixels), as described in further detail below.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronization signal and a horizontal synchronization signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWL, GIL and GBL in response to the first control signal CONT1 received from the driving controller 200. The gate driver 300 may sequentially output the gate signals to the gate lines GWL, GIL and GBL. For example, the gate driver 300 may be integrated in the display panel 100. For example, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

According to exemplary embodiments, the gamma reference voltage generator 400 may be disposed in the driving controller 200 or in the data driver 500.

The data driver 500 receives the second control signal CONT2 and the data signal DATA from the driving controller 200, and receives the gamma reference voltage VGREF from the gamma reference voltage generator 400. The data driver 500 converts the data signal DATA into data voltages having an analog type using the gamma reference voltage VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may output a first back gate signal BS1 to the first back gate signal applying line and a second back gate signal BS2 to the second back gate signal applying line.

In addition, the power voltage generator 700 may generate a high power voltage and a low power voltage of the organic light emitting element of the display panel 100 and output the high power voltage and the low power voltage to the display panel 100.

Figure 4:
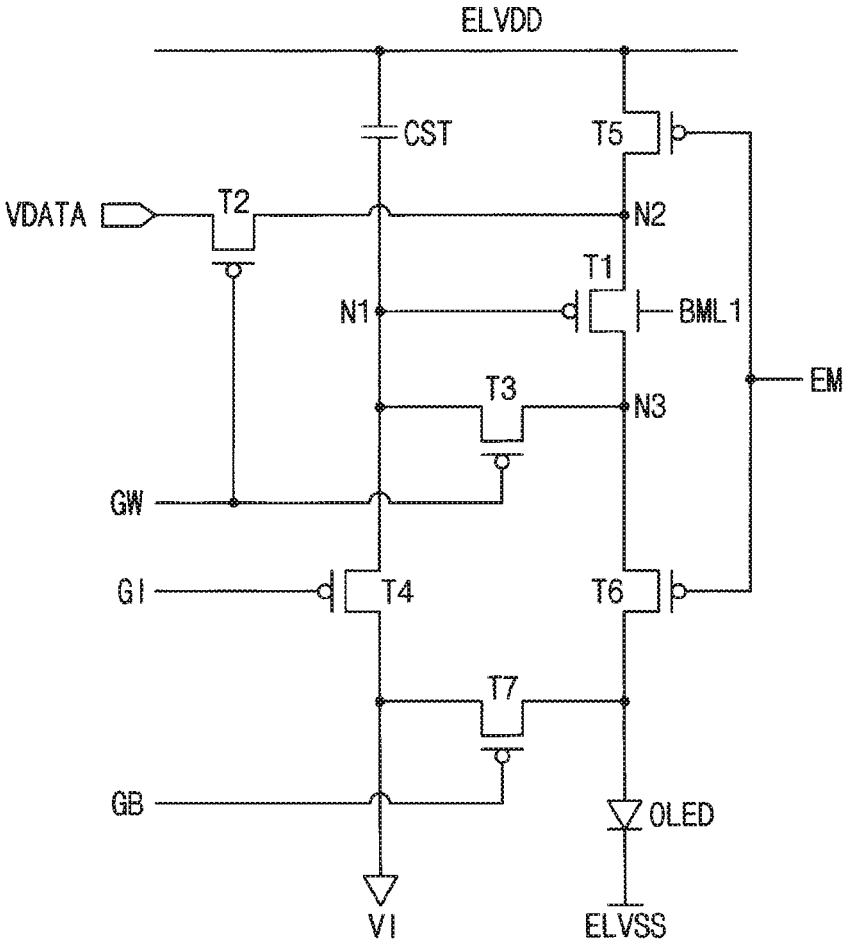
FIG. 4 is a circuit diagram illustrating a pixel of a display panel of FIG. 3.
Figure 5:
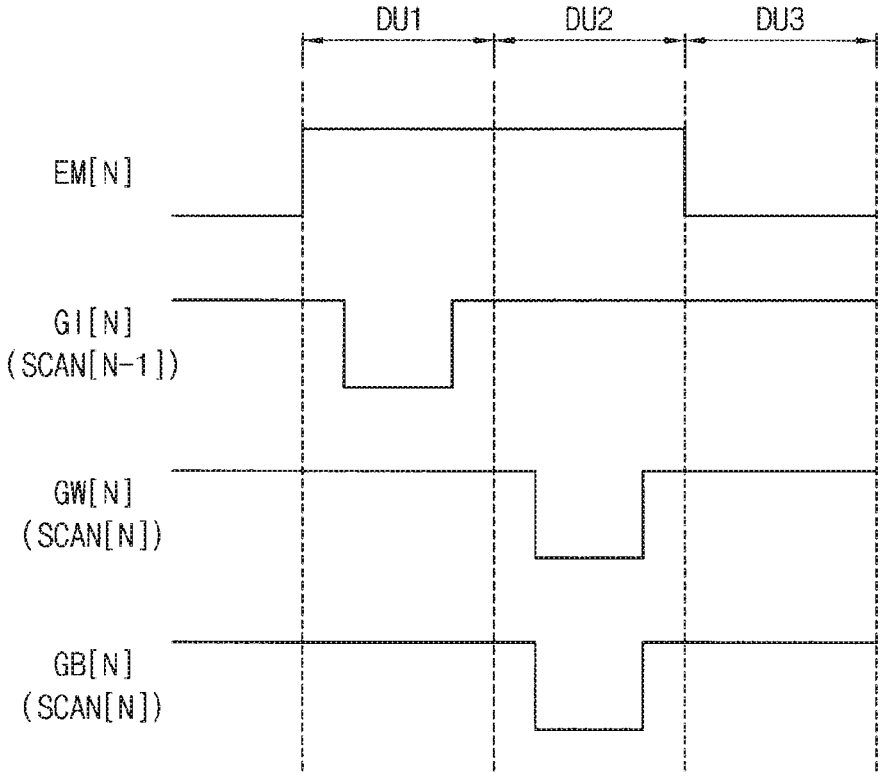
FIG. 5 is a timing diagram illustrating input signals applied to the pixel of FIG. 4.

FIG. 4 is a circuit diagram illustrating a pixel of the display panel 100 of FIG. 3. FIG. 5 is a timing diagram illustrating input signals applied to the pixel of FIG. 4.

Referring to FIGS. 1 to 5, the display panel 100 includes a plurality of pixels. Each pixel includes an organic light emitting element OLED.

The pixel receives a data write gate signal GW, a data initialization gate signal GI, an organic light emitting element initialization gate signal GB, a data voltage VDATA and an emission signal EM, and the organic light emitting element OLED of the pixel emits light corresponding to the level of the data voltage VDATA to display an image.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3.

For example, the first pixel switching element T1 may be a P-type thin film transistor. The control electrode of the first pixel switching element T1 may be a gate electrode. The input electrode of the first pixel switching element T1 may be a source electrode. The output electrode of the first pixel switching element T1 may be a drain electrode.

In an exemplary embodiment, the first pixel switching element T1 may further include a back gate electrode BML1 receiving the first back gate signal BS1 or the second back gate signal BS2.

For example, when the pixel is disposed in the first display area DA1, the first back gate signal BS1 may be applied to the back gate electrode BML1 of the first pixel switching element T1. When the pixel is disposed in the second display area DA2, the second back gate signal BS2 may be applied to the back gate electrode BML1 of the first pixel switching element T1.

The second pixel switching element T2 includes a control electrode receiving the data write gate signal GW, an input electrode receiving the data voltage VDATA and an output electrode connected to the second node N2.

For example, the second pixel switching element T2 may be a P-type thin film transistor. The control electrode of the second pixel switching element T2 may be a gate electrode. The input electrode of the second pixel switching element T2 may be a source electrode. The output electrode of the second pixel switching element T2 may be a drain electrode.

The third pixel switching element T3 includes a control electrode receiving the data write gate signal GW, an input electrode connected to the first node N1 and an output electrode connected to the third node N3.

For example, the third pixel switching element T3 may be a P-type thin film transistor. The control electrode of the third pixel switching element T3 may be a gate electrode. The input electrode of the third pixel switching element T3 may be a source electrode. The output electrode of the third pixel switching element T3 may be a drain electrode.

The fourth pixel switching element T4 includes a control electrode receiving the data initialization gate signal GI, an input electrode receiving an initialization voltage VI and an output electrode connected to the first node N1.

For example, the fourth pixel switching element T4 may be a P-type thin film transistor. The control electrode of the fourth pixel switching element T4 may be a gate electrode. The input electrode of the fourth pixel switching element T4 may be a source electrode. The output electrode of the fourth pixel switching element T4 may be a drain electrode.

The fifth pixel switching element T5 includes a control electrode receiving the emission signal EM, an input electrode receiving a high power voltage ELVDD and an output electrode connected to the second node N2.

For example, the fifth pixel switching element T5 may be a P-type thin film transistor. The control electrode of the fifth pixel switching element T5 may be a gate electrode. The input electrode of the fifth pixel switching element T5 may be a source electrode. The output electrode of the fifth pixel switching element T5 may be a drain electrode.

The sixth pixel switching element T6 includes a control electrode receiving the emission signal EM, an input electrode connected to the third node N3 and an output electrode connected to an anode electrode of the organic light emitting element OLED.

For example, the sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode receiving the organic light emitting element initialization gate signal GB, an input electrode receiving the initialization voltage VI and an output electrode connected to the anode electrode of the organic light emitting element OLED.

For example, the seventh pixel switching element T7 may be a P-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

Although the first to seventh pixel switching elements T1 to T7 are described as being P-type thin film transistors, exemplary embodiments of the present inventive concept are not limited thereto. For example, in exemplary embodiments, the first to seventh pixel switching elements T1 to T7 may be N-type thin film transistors.

The storage capacitor CST includes a first electrode receiving the high power voltage ELVDD and a second electrode connected to the first node N1.

The organic light emitting element OLED includes the anode electrode and a cathode electrode receiving a low power voltage ELVSS.

In FIG. 5, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the data write gate signal GW. During the second duration DU2, the anode electrode of the organic light emitting element OLED is initialized in response to the organic light emitting element initialization gate signal GB. During a third duration DU3, the organic light emitting element OLED emits the light in response to the emission signal EM so that the display panel 100 displays an image.

During the first duration DU1, the data initialization gate signal GI may have an active level. For example, the active level of the data initialization gate signal GI may be a low level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N-1] of a previous stage.

During the second duration DU2, the data write gate signal GW may have an active level. For example, the active level of the data write gate signal GW may be a low level. When the data write gate signal GW has the active level, the second pixel switching element T2 and the third pixel switching element T3 are turned on. In addition, the first pixel switching element T1 is turned on in response to the initialization voltage VI. The data write gate signal GW[N] of the present stage may be generated based on a scan signal SCAN[N] of the present stage.

A voltage, which is a subtracted value of an absolute value |VTH| of the threshold voltage of the first pixel switching element T1 from the data voltage VDATA, may be charged at the first node N1 along a path generated by the first to third pixel switching elements T1, T2 and T3 which are turned on.

During the second duration DU2, the organic light emitting element initialization gate signal GB may have an active level. For example, the active level of the organic light emitting element initialization gate signal GB may be a low level. When the organic light emitting element initialization gate signal GB has the active level, the seventh pixel switching element T7 is turned on so that the initialization voltage VI may be applied to the anode electrode of the organic light emitting element OLED. The organic light emitting element initialization gate signal GB[N] of the present stage may be generated based on the scan signal SCAN[N] of the present stage.

Although the active timing of the organic light emitting element initialization gate signal GB is the same as the active timing of the data write gate signal GW in the exemplary embodiment illustrated in FIG. 5, the present inventive concept is not limited thereto. Alternatively, the active timing of the organic light emitting element initialization gate signal GB may be different from the active timing of the data write gate signal GW. In addition, although the active levels correspond to low levels in FIG. 5, the present inventive concept is not limited thereto. For example, in an exemplary embodiment, the active levels may correspond to high levels.

During the third duration DU3, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1 and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined according to Equation 1:

$$ISD = \frac{1}{2}\mu Cox\frac{W}{L}(VSG - |VTH|)^2 \quad \text{[Equation 1]}$$

In Equation 1, μ is a mobility of the first pixel switching element T1, Cox is a capacitance per unit area of the first pixel switching element T1, W/L is a width to length ratio of the first pixel switching element T1, VSG is a voltage between the input electrode N2 of the first pixel switching element T1 and the control node N1 of the first pixel switching element T1, and |VTH| is the threshold voltage of the first pixel switching element T1.

The voltage VG of the first node N1 after the compensation of the threshold voltage |VTH| during the second duration DU2 may be represented by Equation 2:

$$VG = VDATA - |VTH| \quad \text{[Equation 2]}$$

When the organic light emitting element OLED emits the light during the third duration DU3, the driving voltage VOV and the driving current ISD may be represented by Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{[Equation 3]}$$

$$ISD = \frac{1}{2}\mu Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting element OLED emits the light during the third duration DU3.

Figure 6:
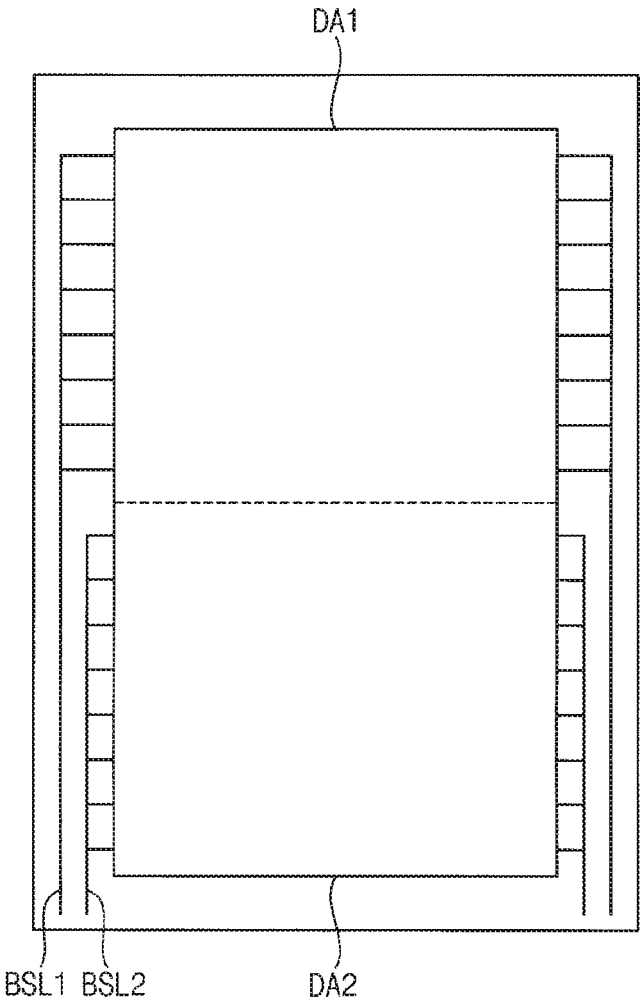
FIG. 6 is a conceptual diagram illustrating a first display area, a second display area, a first back gate signal applying line and a second back gate signal applying line of the display panel of FIG. 3.

FIG. 6 is a conceptual diagram illustrating the first display area DA1, the second display area DA2, the first back gate signal applying line BSL1 and the second back gate signal applying line BSL2 of the display panel 100 of FIG. 3.

Referring to FIGS. 1 to 6, the display panel 100 may include the first display area DA1, the second display area DA2, the first back gate signal applying line BSL1 connected to back gate electrodes (e.g. BML1 in FIG. 4) of pixels in the first display area DA1 and a second back gate signal applying line BSL2 connected to back gate electrodes (e.g. BML1 in FIG. 4) of pixels in the second display area DA2.

The back gate electrodes (e.g. BML1 in FIG. 4) of pixels in the first display area DA1 are connected with each other to form a mesh structure. Thus, the pixels in the first display area DA1 may be controlled together, allowing for all of the pixels to be activated (e.g., emit light) or to be deactivated (e.g., not emit light). This allows the first display area DA1 to display an image, for example, when the first display area DA1 is visible to a user, or to not display an image, for example, when the first display area DA1 is not visible to a user (e.g., if the display apparatus is folded such that the first display area DA1 is not visible to a user). The back gate electrodes (e.g. BML1 in FIG. 4) of pixels in the second display area DA2 are connected with each other to form a mesh structure. Thus, the pixels in the second display area DA2 may be controlled together, allowing for all of the pixels to be activated (e.g., emit light) or to be deactivated (e.g., not emit light). This allows the second display area DA2 to display an image, for example, when the second display area DA2 is visible to a user, or to not display an image, for example, when the second display area DA2 is not visible to a user (e.g., if the display apparatus is folded such that the second display area DA2 is not visible to a user). According to exemplary embodiments, the back gate electrodes of pixels in the first display area DA1 are not connected to the back gate electrodes of pixels in the second display area DA2.

The first back gate signal BS1 applied to the back gate electrodes of pixels in the first display area DA1 may be generated independently from the second back gate signal BS2 applied to the back gate electrodes of pixels in the second display area DA2.

Figure 7:
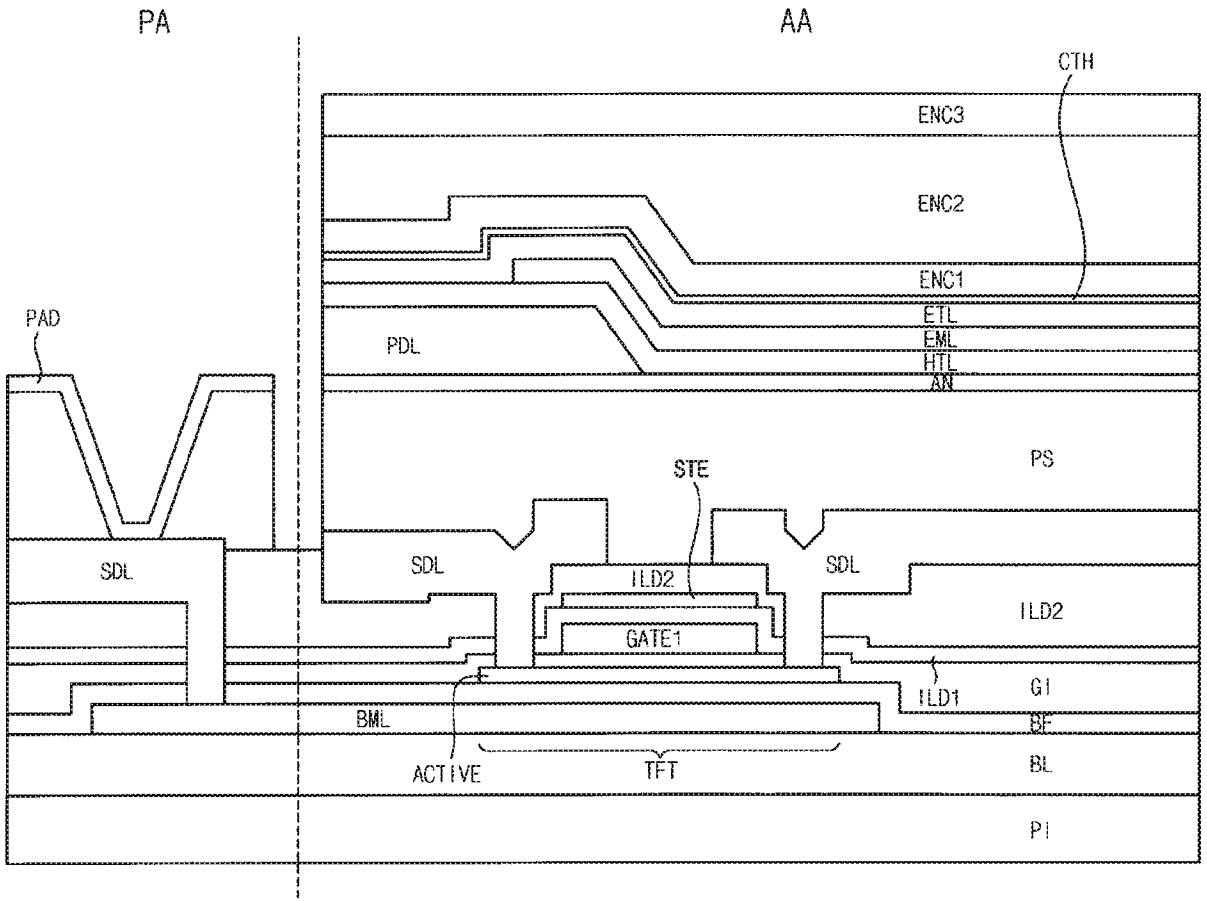
FIG. 7 is a cross-sectional view illustrating the display panel of FIG. 3.

FIG. 7 is a cross-sectional view illustrating the display panel 100 of FIG. 3.

Referring to FIGS. 1 to 7, the display panel 100 may include a display region AA in which an image is displayed and a peripheral region PA adjacent to the display region AA.

The display region AA of the display panel 100 may include a base layer PI, a blocking layer BL disposed on the base layer PI, a back gate electrode BML disposed on the blocking layer BL, a buffer layer BF disposed on the back gate electrode BML, a gate insulating layer GI disposed on the buffer layer BF, an active layer ACTIVE disposed in the gate insulating layer GI, a first gate metal layer GATE1 disposed on the gate insulating layer GI, a first dielectric layer ILD1 disposed on the first gate metal layer GATE1, a second gate metal layer STE disposed on the first dielectric layer ILD1, a second dielectric layer ILD2 disposed on the first dielectric layer ILD1 and the second gate metal layer STE, a source drain metal layer SDL disposed on the second dielectric layer ILD2 and partially passing through the second dielectric layer ILD2, a passivation layer PS disposed on the source drain metal layer SDL, an anode electrode AN disposed on the passivation layer PS, a hole transmitting layer HTL disposed on the anode electrode AN, an emitting layer EML disposed on the hole transmitting layer HTL, an electron transmitting layer ETL disposed on the emitting layer EML, a cathode electrode CTH disposed on the electron transmitting layer ETL and first to third encapsulation layers ENC1, ENC2 and ENC3 sequentially disposed on the cathode electrode CTH. A pixel defining layer PDL may be partially disposed between the anode electrode AN and the hole transmitting layer HTL.

An area in which the active layer ACTIVE and the first gate metal layer GATE1 are overlapped may correspond to the switching element TFT.

The peripheral region PA of the display panel 100 may include the base layer PI, the blocking layer BL disposed on the base layer PI, the back gate electrode BML disposed on the blocking layer BL, the buffer layer BF disposed on the back gate electrode BML, the gate insulating layer GI disposed on the buffer layer BF, the first dielectric layer ILD1 disposed on the gate insulating layer GI, the second dielectric layer ILD2 disposed on the first dielectric layer ILD1, the source drain metal layer SDL disposed on the second dielectric layer ILD2 and partially passing through the second dielectric layer ILD2, the passivation layer PS disposed on the source drain metal layer SDL and a pad part PAD disposed on the passivation layer PS and partially passing through passivation layer PS. The pad part PAD may be disposed on a same layer as the anode electrode AN. The pad part PAD may include a same material as the anode electrode AN.

The back gate signal may be applied to the back gate electrode BML through the pad part PAD and the source drain metal layer SDL of the peripheral region PA.

Figure 8A:
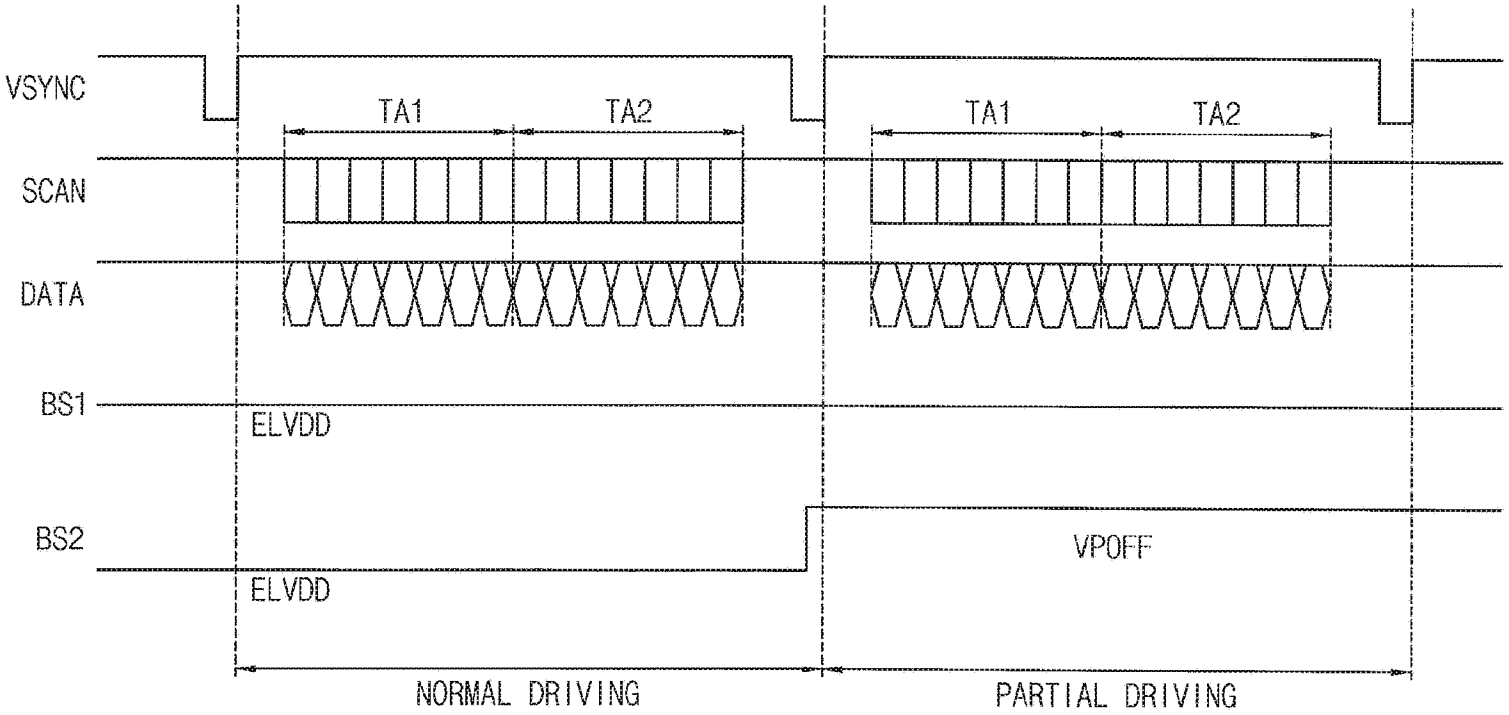
FIG. 8A is a timing diagram illustrating input signals applied to the display panel of FIG. 3.
Figure 8B:
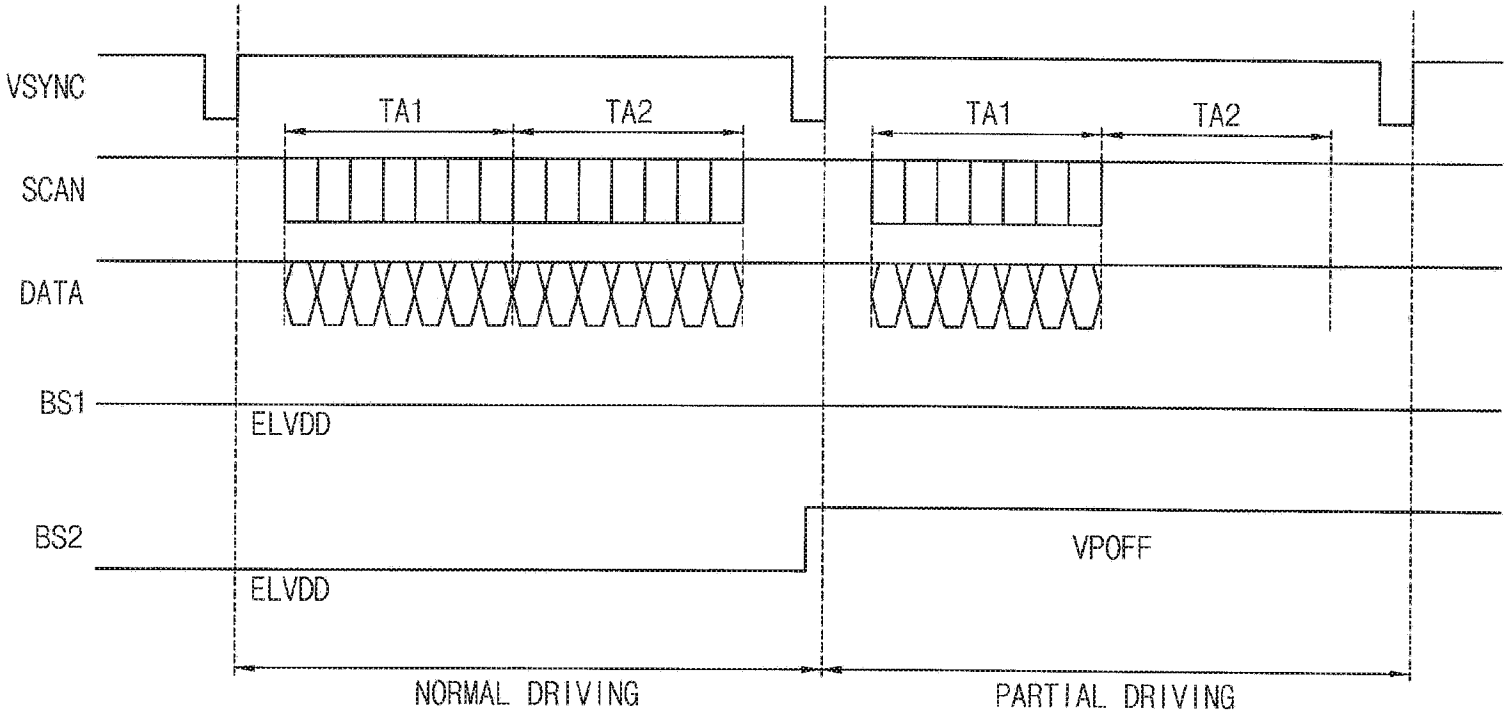
FIG. 8B is a timing diagram illustrating input signals applied to the display panel of FIG. 3.
Figure 8C:
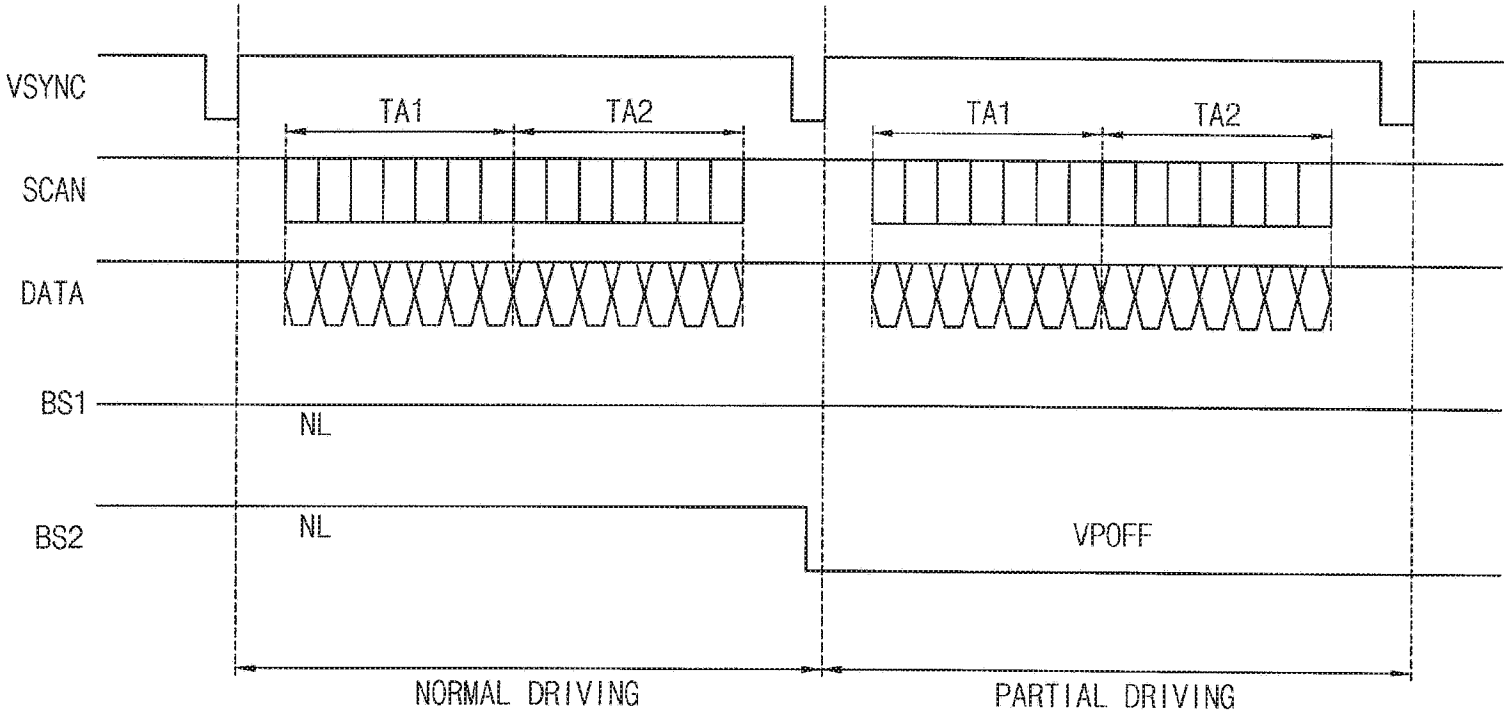
FIG. 8C is a timing diagram illustrating input signals applied to the display panel of FIG. 3.
Figure 8D:
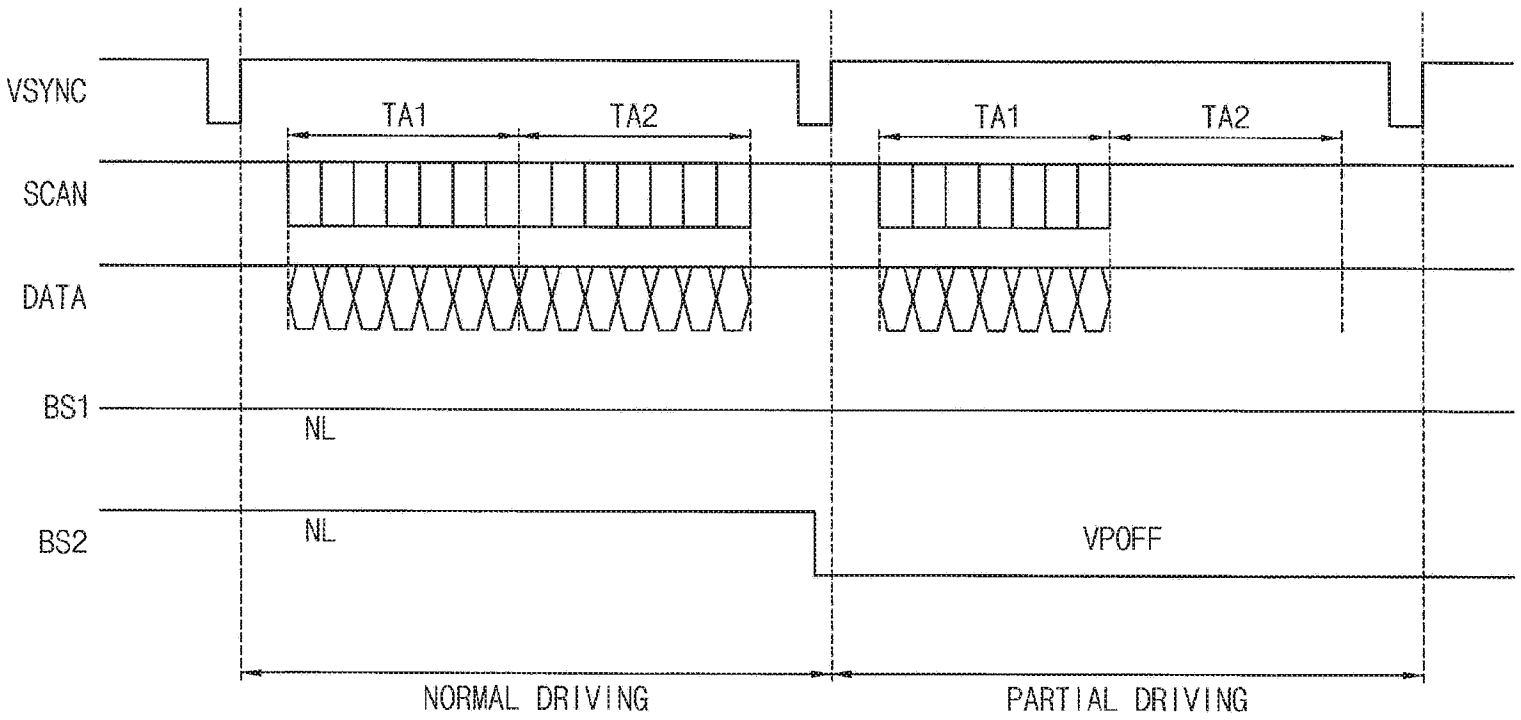
FIG. 8D is a timing diagram illustrating input signals applied to the display panel of FIG. 3.
Figure 9A:
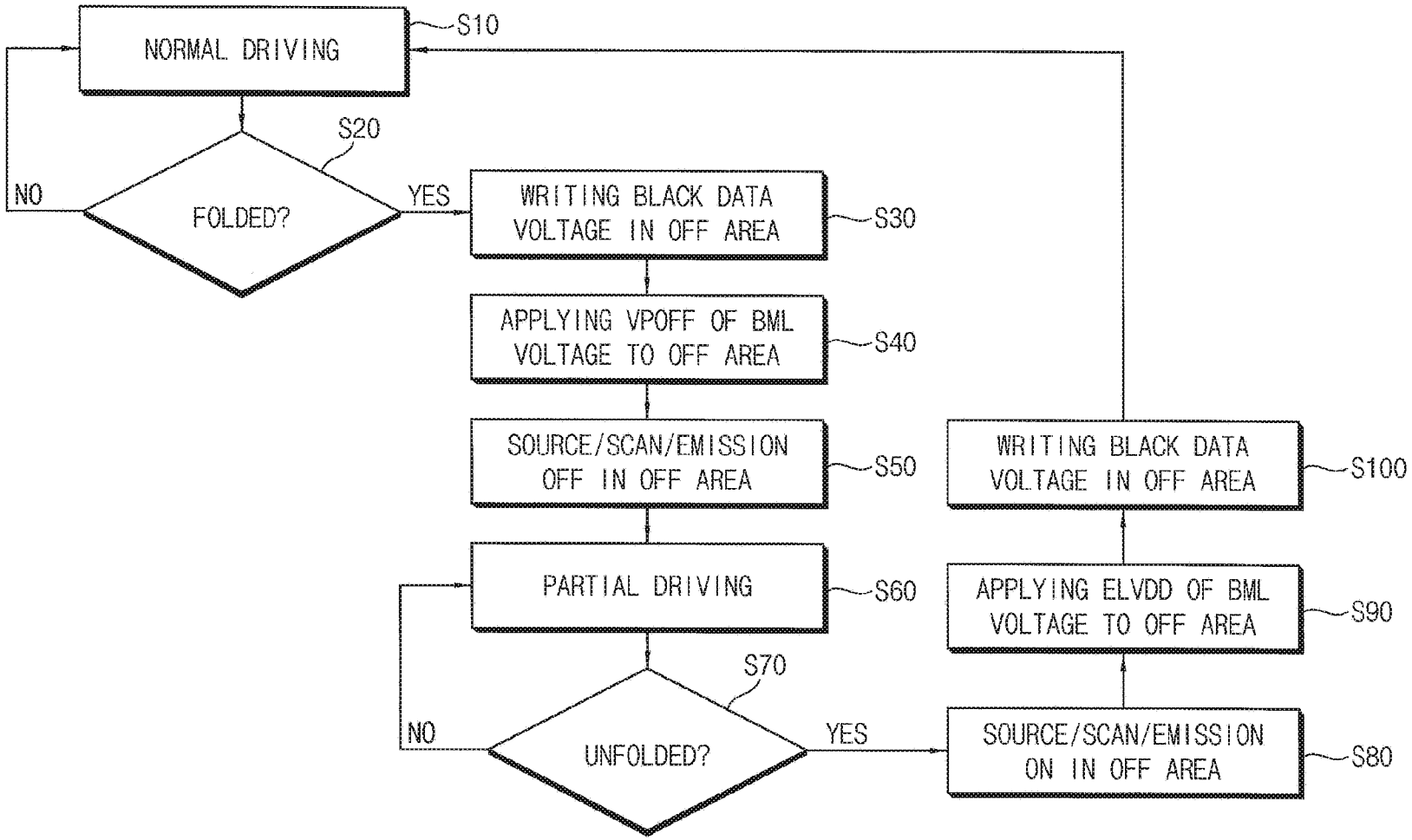
FIG. 9A is a flowchart diagram illustrating a method of driving the display apparatus of FIG. 1 according to an exemplary embodiment.
Figure 9B:
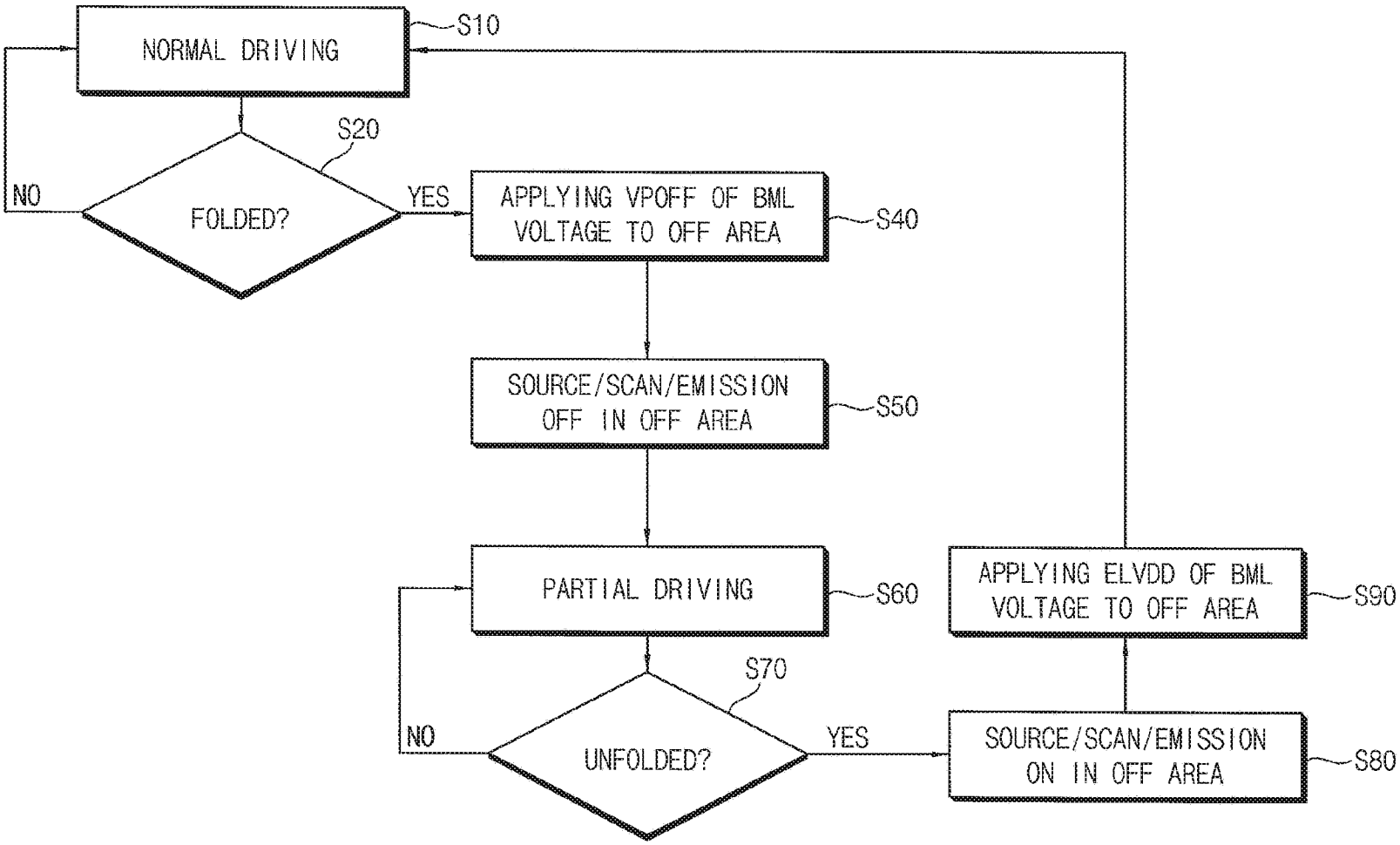
FIG. 9B is a flowchart diagram illustrating a method of driving the display apparatus of FIG. 1 according to an exemplary embodiment.

FIG. 8A is a timing diagram illustrating input signals applied to the display panel 100 of FIG. 3. FIG. 8B is a timing diagram illustrating input signals applied to the display panel 100 of FIG. 3. FIG. 8C is a timing diagram illustrating input signals applied to the display panel 100 of FIG. 3. FIG. 8D is a timing diagram illustrating input signals applied to the display panel 100 of FIG. 3. FIG. 9A is a flowchart diagram illustrating a method of driving the display apparatus of FIG. 1 according to an exemplary embodiment. FIG. 9B is a flowchart diagram illustrating a method of driving the display apparatus of FIG. 1 according to an exemplary embodiment.

Referring to FIGS. 1 to 9B, the display apparatus may be operated in a normal driving mode and a partial driving mode.

When the display panel 100 is in an unfolded state, the display apparatus may operate in the normal driving mode. When the display panel 100 is in a folded state, the display apparatus may operate in the partial driving mode.

In the normal driving mode, the first display area DA1 and the second display area DA2 may display an image. In the normal driving mode, the first display area DA1 and the second display area DA2 may be entirely scanned. As shown in FIGS. 8A to 8D, in the normal driving mode, the gate signal SCAN and the data voltage DATA may be normally applied to the first display area DA1 during a first period TA1 when the first display area DA1 is driven, and the gate signal SCAN and the data voltage DATA may be normally applied to the second display area DA2 during a second period TA2 when the second display area DA2 is driven.

In addition, the first back gate signal BS1 may have a normal level and the second back gate signal BS2 may have a normal level in the normal driving mode. The normal level may mean a level of the first and second back gate signals BS1 and BS2 that does not turn off the pixel switching element, so that the pixel switching element is normally operated by the normal level of the first and second back gate signals BS1 and BS2.

For example, the normal level may be the high power voltage ELVDD of the organic light emitting element OLED.

For example, the first back gate signal BS1 may be substantially the same as the second back gate signal BS2 in the normal driving mode. Thus, in the normal driving mode, both the first back gate signal BS1 and the second back gate signal BS2 may have a normal level, and an image may therefore be displayed in both the first display area DA1 and the second display area DA2 in the normal driving mode.

According to exemplary embodiments, in the partial driving mode, the first display area DA1 displays an image and the second display area DA2 does not display an image.

In FIG. 8A, in the partial driving mode, the gate signal SCAN and the data voltage DATA may be normally applied to the first display area DA1 and the second display area DA2 during the first period TA1 when the first display area DA1 is driven and the second period TA2 when the second display area DA2 is driven.

In addition, the first back gate signal BS1 may have the normal level (e.g. ELVDD) and the second back gate signal BS2 may have an inactive level VPOFF greater than the normal level (e.g. ELVDD) in the partial driving mode. The inactive level VPOFF may mean a level that turns off the pixel switching element by the first and second back gate signals BS1 and BS2.

For example, the inactive level may be a pixel off voltage VPOFF greater than the high power voltage ELVDD of the organic light emitting element OLED in FIG. 8A.

When the pixel off voltage VPOFF is applied to the back gate electrode BML1 of the first pixel switching element T1 of FIG. 4, the first pixel switching element T1 is turned off. When the first pixel switching element T1 is turned off, a current path generated through the fifth pixel switching element T5, the first pixel switching element T1, the sixth pixel switching element T6 and the organic light emitting element OLED is cut so that the pixel does not emit light.

For example, the first back gate signal BS1 may be different from the second back gate signal BS2 in the partial driving mode. In FIG. 8A, the second back gate signal BS2 may be greater than the first back gate signal BS1 in the partial driving mode.

The normal driving mode and the partial driving mode may be determined in a unit of a frame which is defined by the vertical synchronization signal VSYNC.

In FIG. 8B, in the partial driving mode, the gate signal SCAN and the data voltage DATA are normally applied to the first display area DA1 during the first period TA1 when the first display area DA1 is driven, and the gate signal SCAN and the data voltage DATA are not applied to the second display area DA2 during the second period TA2 when the second display area DA2 is driven. As a result, power consumption may be reduced.

In addition, the first back gate signal BS1 may have the normal level (e.g. ELVDD) and the second back gate signal BS2 may have the inactive level VPOFF greater than the normal level (e.g. ELVDD) in the partial driving mode.

In FIGS. 8C and 8D, the switching element (e.g. the first pixel switching element T1) receiving the first back gate signal BS1 or the second back gate signal BS2 is an N-type switching element.

In FIG. 8C, in the partial driving mode, the gate signal SCAN and the data voltage DATA may be normally applied to the first display area DA1 and the second display area DA2 during the first period TA1 when the first display area DA1 is driven and the second period TA2 when the second display area DA2 is driven.

In addition, the first back gate signal BS1 may have the normal level NL and the second back gate signal BS2 may have an inactive level VPOFF less than the normal level NL in the partial driving mode. The inactive level VPOFF may mean a level that turns off the pixel switching element by the first and second back gate signals BS1 and BS2.

For example, the first back gate signal BS1 may be different from the second back gate signal BS2 in the partial driving mode. In FIG. 8C, the second back gate signal BS2 may be less than the first back gate signal BS1 in the partial driving mode.

In FIG. 8D, in the partial driving mode, the gate signal SCAN and the data voltage DATA are normally applied to the first display area DA1 during the first period TA1 when the first display area DA1 is driven, and the gate signal SCAN and the data voltage DATA are not applied to the second display area DA2 during the second period TA2 when the second display area DA2 is driven. As a result, power consumption may be reduced.

In addition, the first back gate signal BS1 may have the normal level NL and the second back gate signal BS2 may have the inactive level VPOFF less than the normal level NL in the partial driving mode.

Referring to FIGS. 9A and 9B, when the display panel 100 is in the unfolded state, the display panel 100 may be driven in the normal driving mode (operation S10).

The folded state of the display panel 100 may be determined in operation S20. When the display panel 100 is not folded, the normal driving mode may be maintained. Alternatively, when the display panel 100 is folded, the display panel 100 may be driven in the partial driving mode.

When the display panel 100 is folded, a black data voltage may be written in an off area (e.g. the second display area DA2) in which the image should not be displayed (operation S30 in FIG. 9A). The operation S30 of writing the black data voltage in the off area (e.g. the second display area DA2) is an operation performed to stabilize the display image. Operation S30 may be omitted in an exemplary embodiment, as shown in FIG. 9B.

When the display panel 100 is folded, the back gate signal (e.g. the second back gate signal BS2) corresponding to the off area may be increased from the normal level to the inactive level VPOFF greater than the normal level (operation S40).

When the display panel 100 is folded, at least one of the gate driver 300, the data driver 500 and the emission driver 600 do not output the driving signal to the off area (operation S50). For example, in an exemplary embodiment, when the display panel 100 is folded, the gate driver 300 does not output a gate signal to the off area, the data driver 500 does not output a data voltage to the off area and/or the emission driver 600 does not output an emission signal to the off area.

For example, when the display panel 100 is folded, a carry signal is not transmitted to a portion of the gate driver 300 corresponding to the off area so that the gate driver 300 does not output the gate signal GW, GI and GB to the off area. For example, the carry signal may cause the transmission of the gate signal GW, GI and GB by the gate driver 300, and when the display panel 100 is folded, the carry signal is not transmitted to the portion of the gate driver 300 that drives the off area.

For example, when the display panel 100 is folded, an output buffer of the data driver 500 is deactivated when outputting the data voltage VDATA to the off area so that the data driver 500 does not output the data voltage VDATA to the off area.

For example, when the display panel 100 is folded, a carry signal is not transmitted to a portion of the emission driver 600 corresponding to the off area so that the emission driver 600 does not output the emission signal EM to the off area.

As described above, when the display panel 100 is folded, the display apparatus may operate in the partial driving mode by performing operations S30, S40 and S50. The display apparatus changes to the partial driving mode in operation S60.

An unfolding action of the display panel 100 may be determined in the folded state of the display panel 100 (operation S70). For example, at operation S70, it is determined whether the display panel 100 has been unfolded. When the display panel 100 is not unfolded, the partial driving mode may be maintained. Alternatively, when the display panel 100 is unfolded, the display panel 100 may be driven in the normal driving mode.

When the display panel 100 is unfolded, the deactivated element among the gate driver 300, the data driver 500 and the emission driver 600 may be activated. Thus, when the display panel 100 is unfolded, the gate driver 300, the data driver 500 and the emission driver 600 may output the driving signal to the first display area DA1 and the second display area DA2 of the display panel 100 (operation S80).

When the display panel 100 is changed from the folded state to the unfolded state, the back gate signal (e.g. the second back gate signal BS2) corresponding to the off area in the folded state may be decreased from the inactive level VPOFF to the normal level (e.g. ELVDD) (operation S90).

When the display panel 100 is unfolded, the black data voltage may be temporally written in the off area (e.g. the second display area DA2) of the folded state (operation S100 in FIG. 9A) to prevent an undesired image from being shown to a user right after unfolding the display panel 100. The operation S100 temporally writing the black data voltage in the off area (e.g. the second display area DA2) is an operation to stabilize the display image, and may be omitted in exemplary embodiments, as shown in FIG. 9B.

As described above, when the display panel 100 is unfolded, the display apparatus may operate in the normal driving mode by the performance of operations S80, S90 and S100 (operation S10).

According to an exemplary embodiment described with reference to FIGS. 1 to 9B, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 10:
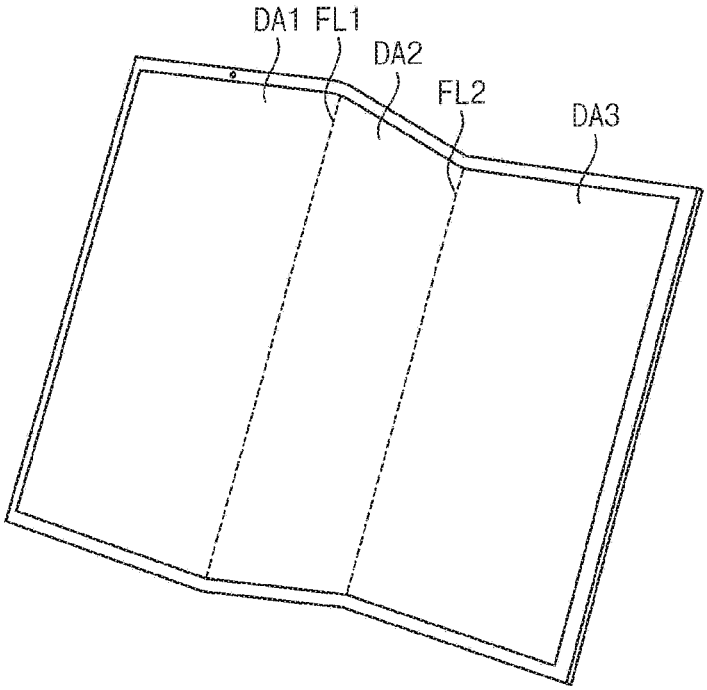
FIG. 10 is a perspective view illustrating a display apparatus according to an exemplary embodiment of the present inventive concept.
Figure 11:
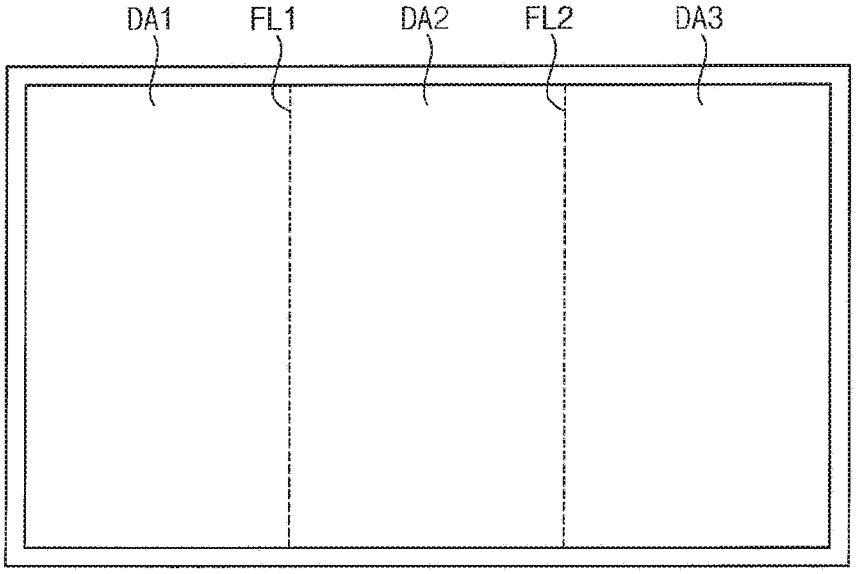
FIG. 11 is a plan view illustrating the display apparatus of FIG. 10.
Figure 12:
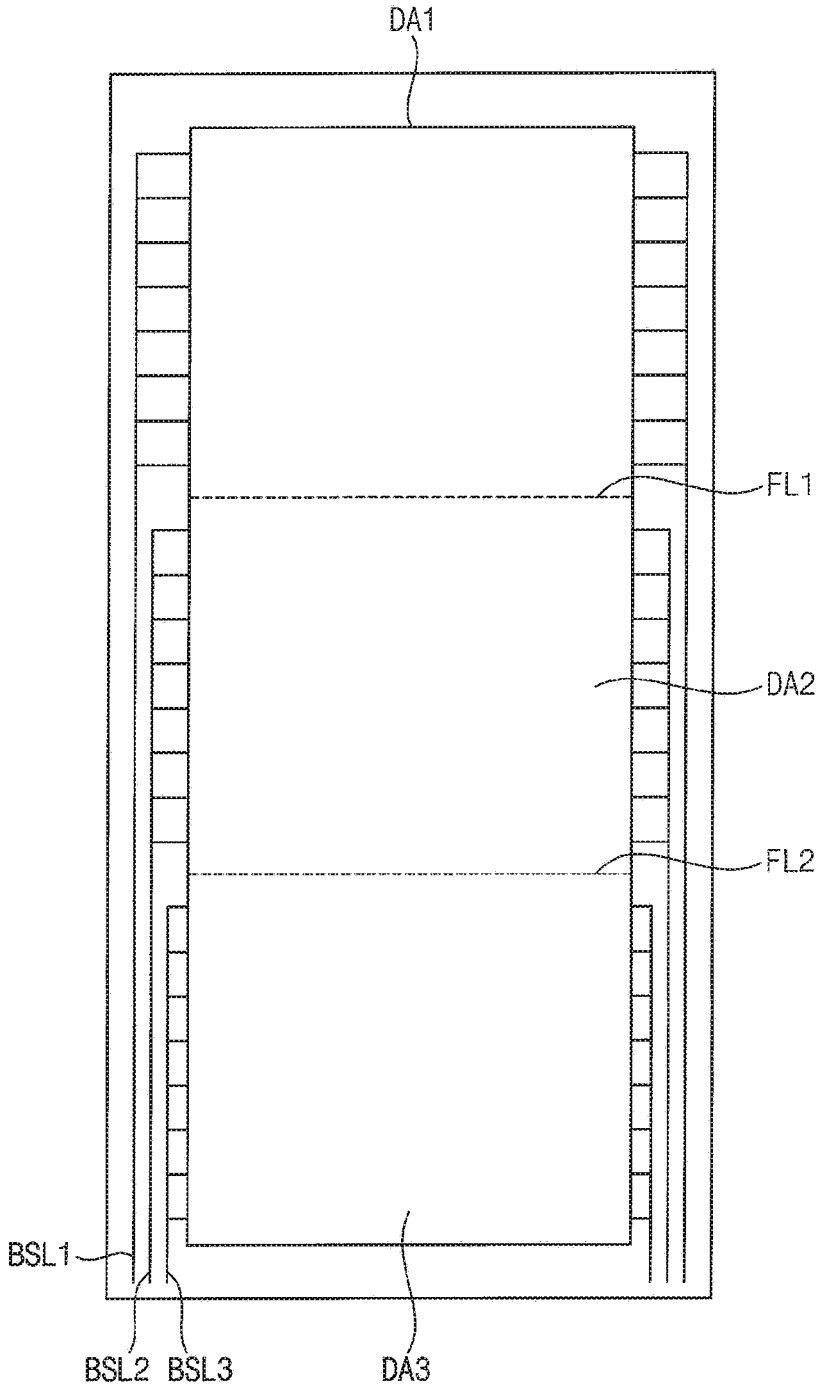
FIG. 12 is a conceptual diagram illustrating a first display area, a second display area, a third display area, a first back gate signal transmitting line, a second back gate signal applying line and a third back gate signal applying line of the display panel of FIG. 10.

FIG. 10 is a perspective view illustrating a display apparatus according to an exemplary embodiment of the present inventive concept. FIG. 11 is a plan view illustrating the display apparatus of FIG. 10. FIG. 12 is a conceptual diagram illustrating a first display area DA1, a second display area DA2, a third display area DA3, a first back gate signal BSL1 transmitting line, a second back gate signal applying line BSL2 and a third back gate signal applying line BSL3 of the display panel of FIG. 10.

A display apparatus and a method of driving the display apparatus according to an exemplary embodiment described with reference to FIGS. 10 to 12 is substantially the same as the display apparatus and the method of driving the display apparatus of an exemplary embodiment described with reference to FIGS. 1 to 9B, except that the display panel includes three display areas. Thus, for convenience of explanation, the same reference numerals will be used to refer to the same or like parts as those described above with reference to FIGS. 1 to 9B, and any repetitive explanation concerning the above elements will be omitted.

Referring to FIGS. 3 to 5 and 7 to 12, the display apparatus may include a flexible display panel. The display apparatus may be a foldable display apparatus. The display apparatus may be folded along a first folding line FL1 and a second folding line FL2.

The display apparatus may include a first display area DA1 disposed on a first side of the first folding line FL1, a second display area DA2 disposed on a second side of the first folding line FL1 and on a first side of the second folding line FL2, and a third display area DA3 disposed on a second side of the second folding line FL2.

In an exemplary embodiment, when the display apparatus is folded as shown in FIG. 10, the first display area DA1 may display an image, and the second display area DA2 and the third display area DA3 do not display an image. Alternatively, when the display apparatus is folded, the third display area DA3 may display an image, and the first display area DA1 and the second display area DA2 do not display an image according to a user setting.

The display panel 100 may include a first back gate signal applying line BSL1 connected to back gate electrodes (e.g. BML1 in FIG. 4) of pixels in the first display area DA1, a second back gate signal applying line BSL2 connected to back gate electrodes (e.g. BML1 in FIG. 4) of pixels in the second display area DA2 and a third back gate signal applying line BSL3 connected to back gate electrodes (e.g. BML1 in FIG. 4) of pixels in the third display area DA3.

The back gate electrodes (e.g. BML1 in FIG. 4) of pixels in the first display area DA1 are connected with each other to form a mesh structure. Thus, the pixels in the first display area DA1 may be controlled together, allowing for all of the pixels to be activated (e.g., emit light) or to be deactivated (e.g., not emit light). This allows the first display area DA1 to display an image, for example, when the first display area DA1 is visible to a user, or to not display an image, for example, when the first display area DA1 is not visible to a user (e.g., if the display apparatus is folded such that the first display area DA1 is not visible to a user). The back gate electrodes (e.g. BML1 in FIG. 4) of pixels in the second display area DA2 are connected with each other to form a mesh structure. Thus, the pixels in the second display area DA2 may be controlled together, allowing for all of the pixels to be activated (e.g., emit light) or to be deactivated (e.g., not emit light). This allows the second display area DA2 to display an image, for example, when the second display area DA2 is visible to a user, or to not display an image, for example, when the second display area DA2 is not visible to a user (e.g., if the display apparatus is folded such that the second display area DA2 is not visible to a user). The back gate electrodes (e.g. BML1 in FIG. 4) of pixels in the third display area DA3 are connected with each other to form a mesh structure. Thus, the pixels in the third display area DA3 may be controlled together, allowing for all of the pixels to be activated (e.g., emit light) or to be deactivated (e.g., not emit light). This allows the third display area DA3 to display an image, for example, when the third display area DA3 is visible to a user, or to not display an image, for example, when the third display area DA3 is not visible to a user (e.g., if the display apparatus is folded such that the third display area DA3 is not visible to a user). According to exemplary embodiments, the back gate electrodes of pixels in the first display area DA1, the back gate electrodes of pixels in the second display area DA2 and the back gate electrodes of pixels in the third display area DA3 are not connected to each other.

The first back gate signal BS1 applied to the back gate electrodes of pixels in the first display area DA1, the second back gate signal BS2 applied to the back gate electrodes of pixels in the second display area DA2 and the third back gate signal BS3 applied to the back gate electrodes of pixels in the third display area DA3 may be generated independently from one another.

According to an exemplary embodiment described with reference to FIGS. 10 to 12, the independent back gate signals BS1, BS2 and BS3 are applied to the first back gate electrodes disposed in the first display area DA1, the second back gate electrodes disposed in the second display area DA2 and the third back gate electrodes disposed in the third display area DA3 so that the pixels in the inactive areas DA2 and DA3 may be controlled not to emit light. In addition, the gate driver 300 does not output the gate signal to the inactive areas DA2 and DA3, the data driver 500 does not output the data voltage to the inactive areas DA2 and DA3 and the emission driver 600 does not output the emission signal to the inactive areas DA2 and DA3 in a folded state of the display panel. Thus, the power consumption of the display apparatus may be reduced.

Figure 13:
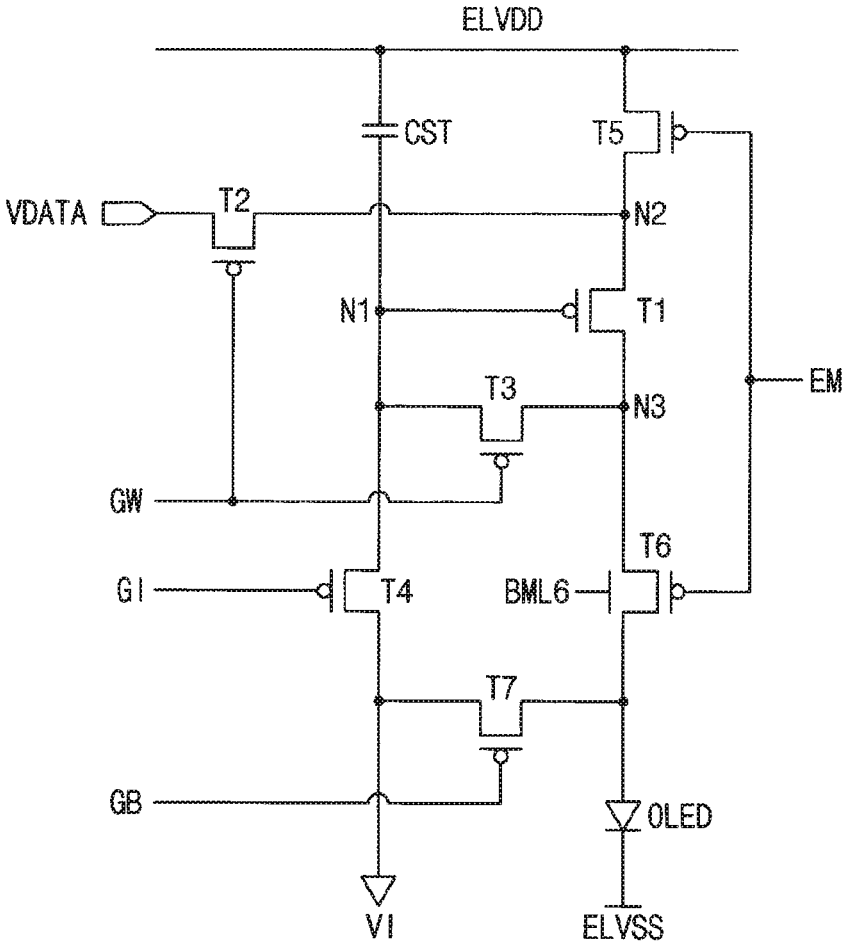
FIG. 13 is a circuit diagram illustrating a pixel of a display panel of a display apparatus according to an exemplary embodiment of the present inventive concept.

FIG. 13 is a circuit diagram illustrating a pixel of a display panel of a display apparatus according to an exemplary embodiment of the present inventive concept.

A display apparatus and a method of driving the display apparatus according to the exemplary embodiment described with reference to FIG. 13 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 13, the display apparatus may include a flexible display panel. The display apparatus may be a foldable display apparatus.

In an exemplary embodiment according to FIGS. 1 to 3, 5 to 9B and 13, the sixth pixel switching element T6 of the pixel may include the back gate electrode BML6.

The display panel 100 may include the first display area DA1, the second display area DA2, the first back gate signal applying line BSL1 connected to back gate electrodes (e.g. BML6 in FIG. 13) of pixels in the first display area DA1 and a second back gate signal applying line BSL2 connected to back gate electrodes (e.g. BML6 in FIG. 13) of pixels in the second display area DA2.

The display apparatus may operate in a normal driving mode and a partial driving mode.

When the display panel 100 is in an unfolded state, the display apparatus may be operated in the normal driving mode. When the display panel 100 is in a folded state, the display apparatus may operate in the partial driving mode.

The first back gate signal BS1 may have a normal level and the second back gate signal BS2 may have a normal level in the normal driving mode. The first back gate signal BS1 may have the normal level and the second back gate signal BS2 may have an inactive level greater than the normal level in the partial driving mode.

When the pixel off voltage VPOFF is applied to the back gate electrode BML6 of the sixth pixel switching element T6 of FIG. 13, the sixth pixel switching element T6 is turned off. When the sixth pixel switching element T6 is turned off, a current path generated through the fifth pixel switching element T5, the first pixel switching element T1, the sixth pixel switching element T6 and the organic light emitting element OLED is cut so that the pixel does not emit light.

According to the an exemplary embodiment according to FIGS. 1 to 3, 5 to 9B and 13, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 14:
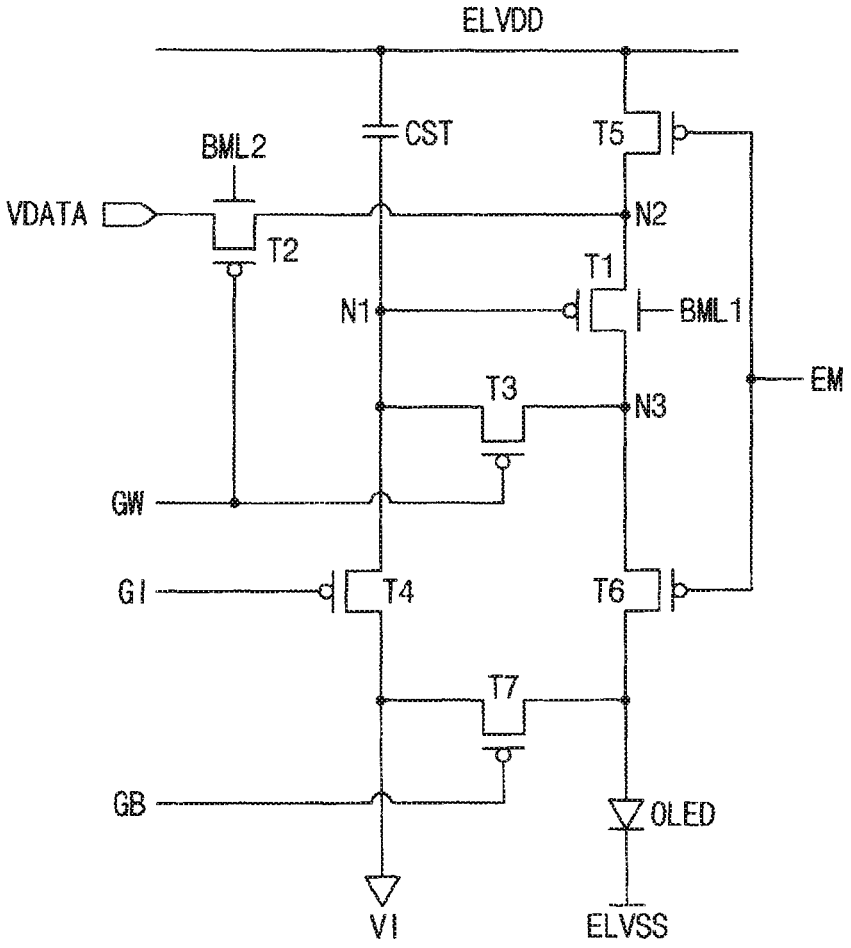
FIG. 14 is a circuit diagram illustrating a pixel of a display panel of a display apparatus according to an exemplary embodiment of the present inventive concept.

FIG. 14 is a circuit diagram illustrating a pixel of a display panel of a display apparatus according to an exemplary embodiment of the present inventive concept.

A display apparatus and a method of driving the display apparatus according to an exemplary embodiment described with reference to FIG. 14 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 14, the display apparatus may include a flexible display panel. The display apparatus may be a foldable display apparatus.

In an exemplary embodiment according to FIGS. 1 to 3, 5 to 9B and 14, the first pixel switching element T1 and the second pixel switching element T2 of the pixel may include the back gate electrodes BML1 and BML2.

When the pixel off voltage VPOFF is applied to the back gate electrodes BML1 and BML2 of the first and second pixel switching elements T1 and T2 of FIG. 14, the first and second pixel switching elements T1 and T2 are turned off. When the first and second pixel switching elements T1 and T2 are turned off, a current path generated through the fifth pixel switching element T5, the first pixel switching element T1, the sixth pixel switching element T6 and the organic light emitting element OLED is cut so that the pixel does not emit light.

According to an exemplary embodiment according to FIGS. 1 to 3, 5 to 9B and 14, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 15:
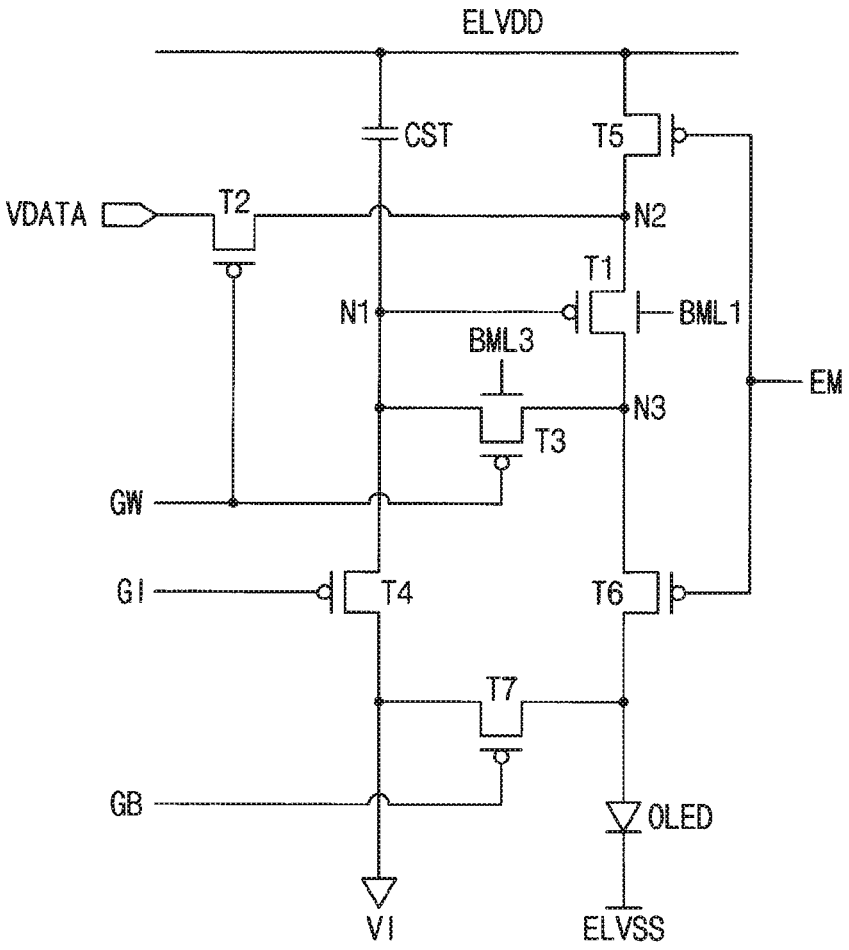
FIG. 15 is a circuit diagram illustrating a pixel of a display panel of a display apparatus according to an exemplary embodiment of the present inventive concept.

FIG. 15 is a circuit diagram illustrating a pixel of a display panel of a display apparatus according to an exemplary embodiment of the present inventive concept.

A display apparatus and a method of driving the display apparatus according to an exemplary embodiment described with reference to FIG. 15 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 15, the display apparatus may include a flexible display panel. The display apparatus may be a foldable display apparatus.

In an exemplary embodiment according to FIGS. 1 to 3, 5 to 9B and 15, the first pixel switching element T1 and the third pixel switching element T3 of the pixel may include the back gate electrodes BML1 and BML3.

When the pixel off voltage VPOFF is applied to the back gate electrodes BML1 and BML3 of the first and third pixel switching elements T1 and T3 of FIG. 15, the first and third pixel switching elements T1 and T3 are turned off. When the first and third pixel switching elements T1 and T3 are turned off, a current path generated through the fifth pixel switching element T5, the first pixel switching element T1, the sixth pixel switching element T6 and the organic light emitting element OLED is cut so that the pixel does not emit light.

According to an exemplary embodiment according to FIGS. 1 to 3, 5 to 9B and 15, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 16:
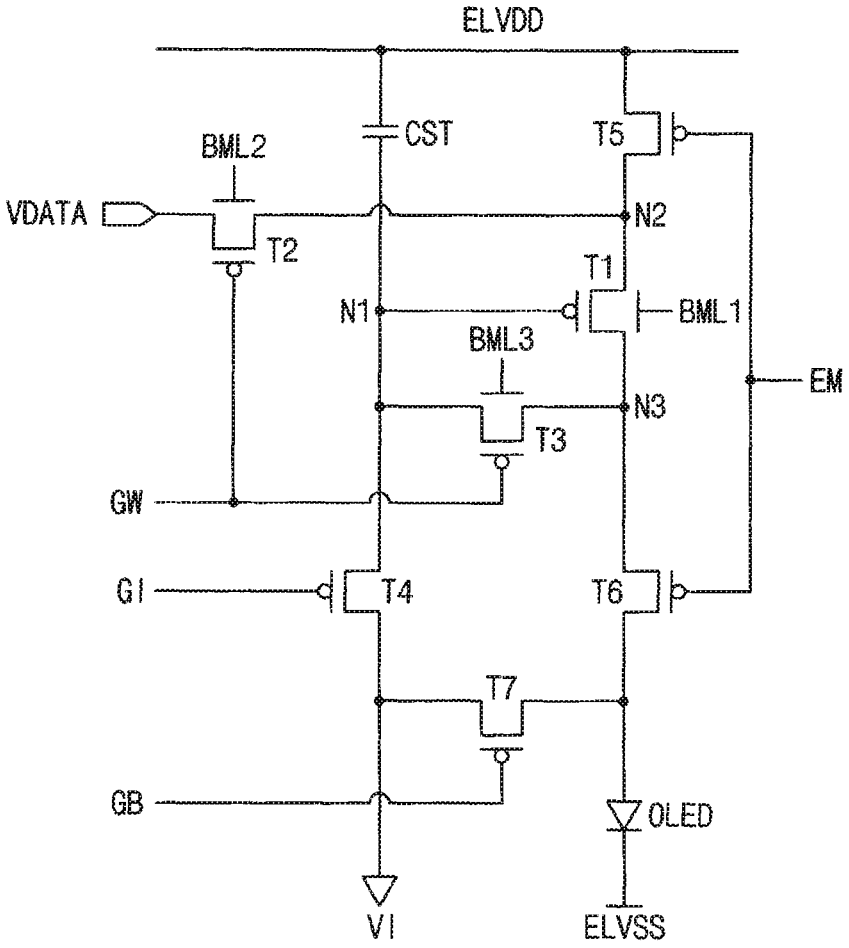
FIG. 16 is a circuit diagram illustrating a pixel of a display panel of a display apparatus according to an exemplary embodiment of the present inventive concept.

FIG. 16 is a circuit diagram illustrating a pixel of a display panel of a display apparatus according to an exemplary embodiment of the present inventive concept.

A display apparatus and a method of driving the display apparatus according to an exemplary embodiment described with reference to FIG. 16 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 16, the display apparatus may include a flexible display panel. The display apparatus may be a foldable display apparatus.

In an exemplary embodiment according to FIGS. 1 to 3, 5 to 9B and 16, the first pixel switching element T1, the second pixel switching element T2 and the third pixel switching element T3 of the pixel may include the back gate electrodes BML1, BML2 and BML3.

When the pixel off voltage VPOFF is applied to the back gate electrodes BML1, BML2 and BML3 of the first, second and third pixel switching elements T1, T2 and T3 of FIG. 16, the first, second and third pixel switching elements T1, T2 and T3 are turned off. When the first, second and third pixel switching elements T1, T2 and T3 are turned off, a current path generated through the fifth pixel switching element T5, the first pixel switching element T1, the sixth pixel switching element T6 and the organic light emitting element OLED is cut so that the pixel does not emit light.

According to an exemplary embodiment according to FIGS. 1 to 3, 5 to 9B and 16, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 17:
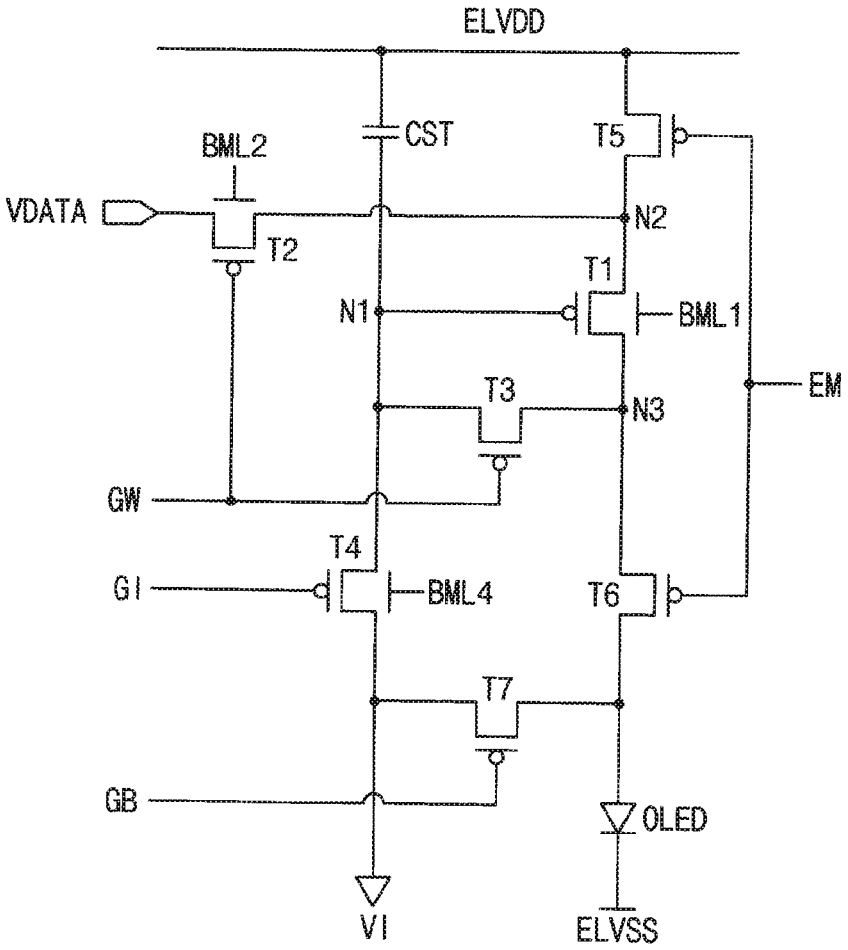
FIG. 17 is a circuit diagram illustrating a pixel of a display panel of a display apparatus according to an exemplary embodiment of the present inventive concept.

FIG. 17 is a circuit diagram illustrating a pixel of a display panel of a display apparatus according to an exemplary embodiment of the present inventive concept.

A display apparatus and a method of driving the display apparatus according to an exemplary embodiment described with reference to FIG. 17 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 17, the display apparatus may include a flexible display panel. The display apparatus may be a foldable display apparatus.

In an exemplary embodiment according to FIGS. 1 to 3, 5 to 9B and 17, the first pixel switching element T1, the second pixel switching element T2 and the fourth pixel switching element T4 of the pixel may include the back gate electrodes BML1, BML2 and BML4.

Figure 18:
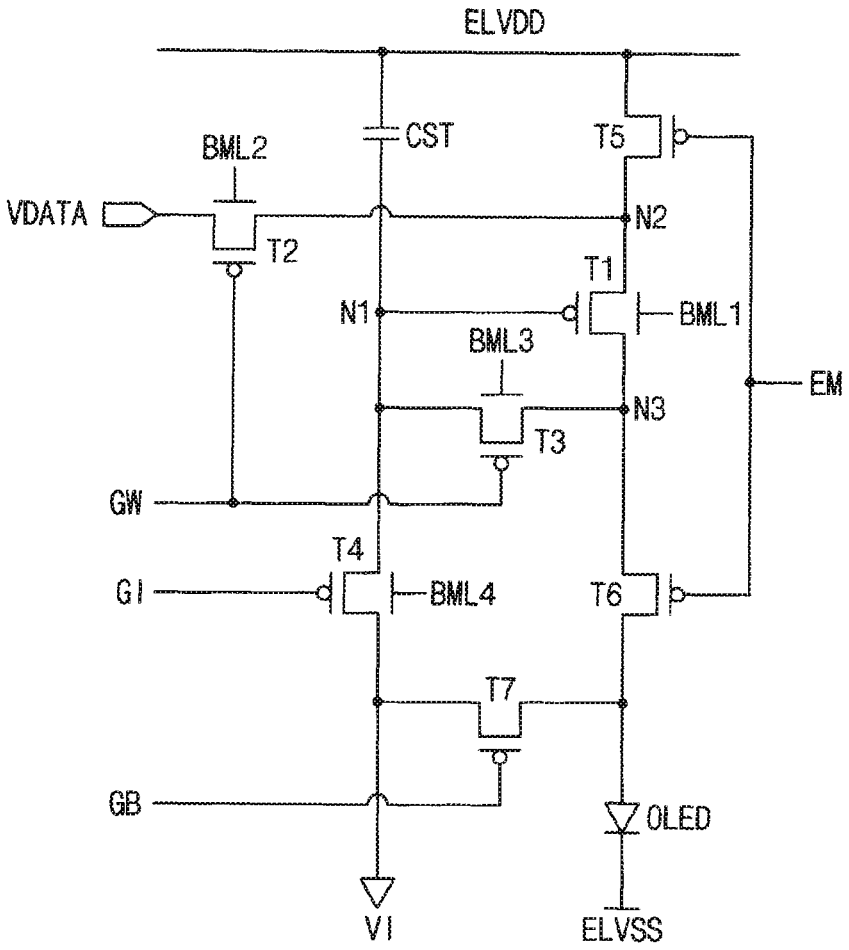
FIG. 18 is a circuit diagram illustrating a pixel of a display panel of a display apparatus according to an exemplary embodiment of the present inventive concept.

FIG. 18 is a circuit diagram illustrating a pixel of a display panel of a display apparatus according to an exemplary embodiment of the present inventive concept.

A display apparatus and a method of driving the display apparatus according to an exemplary embodiment described with reference to FIG. 18 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 18, the display apparatus may include a flexible display panel. The display apparatus may be a foldable display apparatus.

In an exemplary embodiment according to FIGS. 1 to 3, 5 to 9B and 18, the first pixel switching element T1, the second pixel switching element T2, the third pixel switching element T3 and the fourth pixel switching element T4 of the pixel may include the back gate electrodes BML1, BML2, BML3 and BML4.

Figure 19:
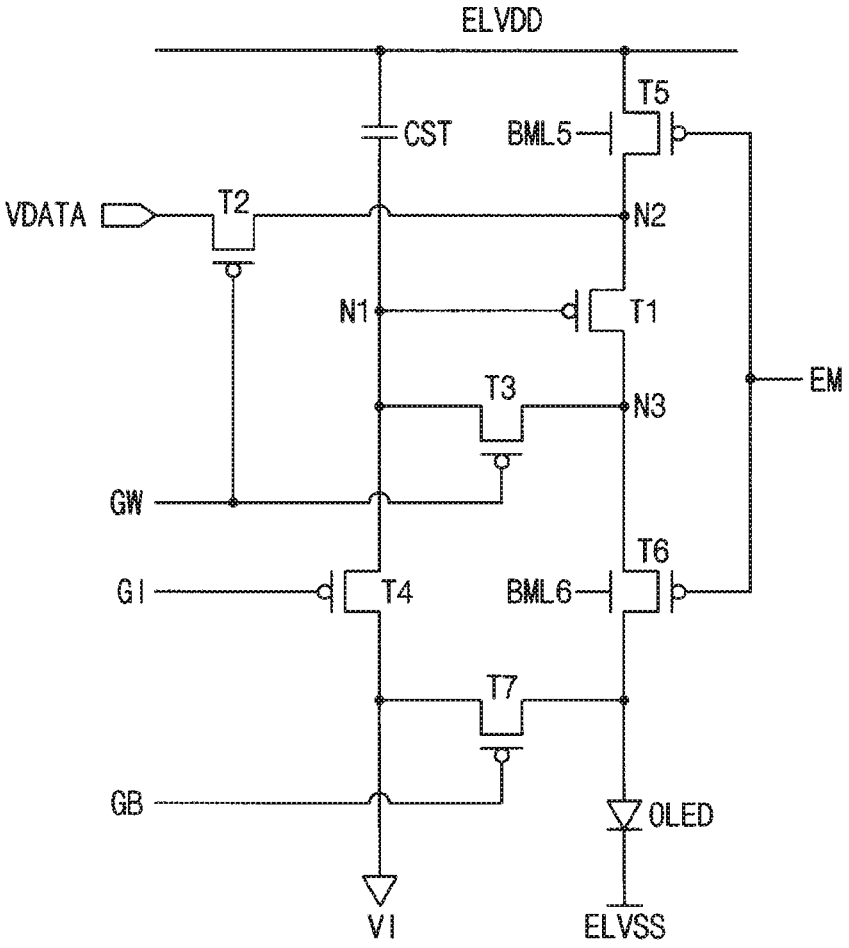
FIG. 19 is a circuit diagram illustrating a pixel of a display panel of a display apparatus according to an exemplary embodiment of the present inventive concept.

FIG. 19 is a circuit diagram illustrating a pixel of a display panel of a display apparatus according to an exemplary embodiment of the present inventive concept.

A display apparatus and a method of driving the display apparatus according to an exemplary embodiment described with reference to FIG. 19 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described in the previous exemplary embodiment of FIGS. 1 to 9B, and any repetitive explanation concerning the above elements will be omitted.

Referring to FIGS. 1 to 3, 5 to 9B and 19, the display apparatus may include a flexible display panel. The display apparatus may be a foldable display apparatus.

In an exemplary embodiment according to FIGS. 1 to 3, 5 to 9B and 19, the fifth pixel switching element T5 and the sixth pixel switching element T6 of the pixel may include the back gate electrodes BML5 and BML6.

Figure 20:
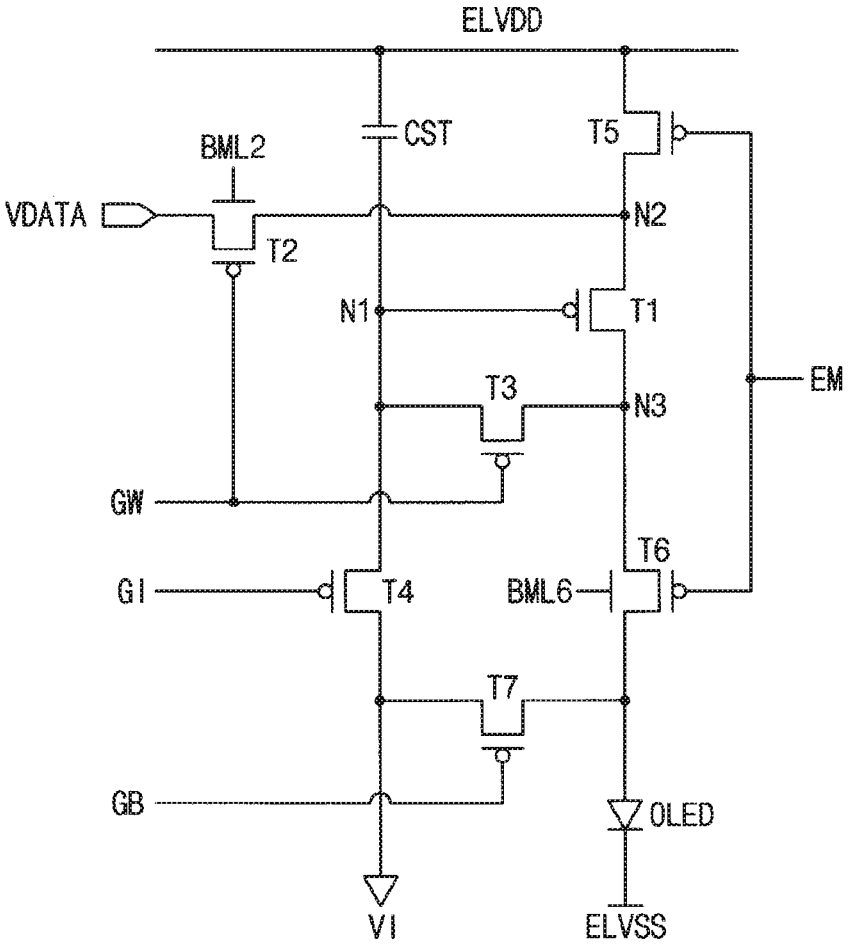
FIG. 20 is a circuit diagram illustrating a pixel of a display panel of a display apparatus according to an exemplary embodiment of the present inventive concept.

FIG. 20 is a circuit diagram illustrating a pixel of a display panel of a display apparatus according to an exemplary embodiment of the present inventive concept.

A display apparatus and a method of driving the display apparatus according to an exemplary embodiment described with reference to FIG. 20 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 20, the display apparatus may include a flexible display panel. The display apparatus may be a foldable display apparatus.

In an exemplary embodiment according to FIGS. 1 to 3, 5 to 9B and 20, the second pixel switching element T2 and the sixth pixel switching element T6 of the pixel may include the back gate electrodes BML2 and BML6.

Figure 21:
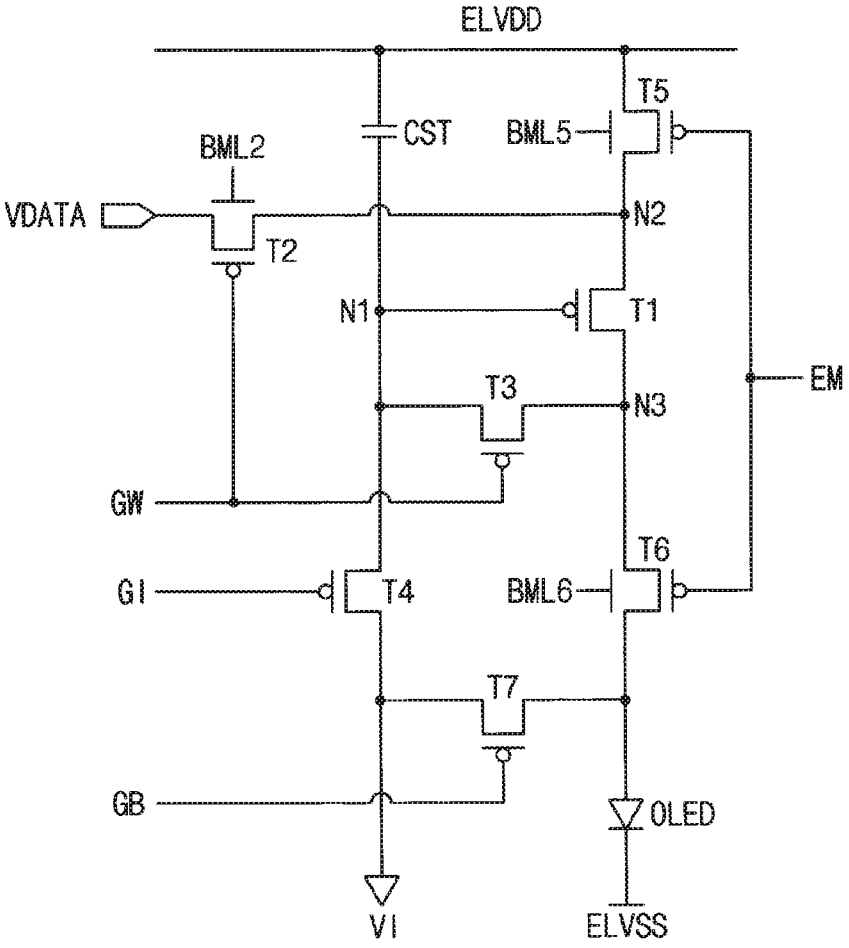
FIG. 21 is a circuit diagram illustrating a pixel of a display panel of a display apparatus according to an exemplary embodiment of the present inventive concept.

FIG. 21 is a circuit diagram illustrating a pixel of a display panel of a display apparatus according to an exemplary embodiment of the present inventive concept.

A display apparatus and a method of driving the display apparatus according to an exemplary embodiment described with reference to FIG. 21 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 21, the display apparatus may include a flexible display panel. The display apparatus may be a foldable display apparatus.

In an exemplary embodiment according to FIGS. 1 to 3, 5 to 9B and 21, the second pixel switching element T2, the fifth pixel switching element T5 and the sixth pixel switching element T6 of the pixel may include the back gate electrodes BML2, BML5 and BML6.

Figure 22:
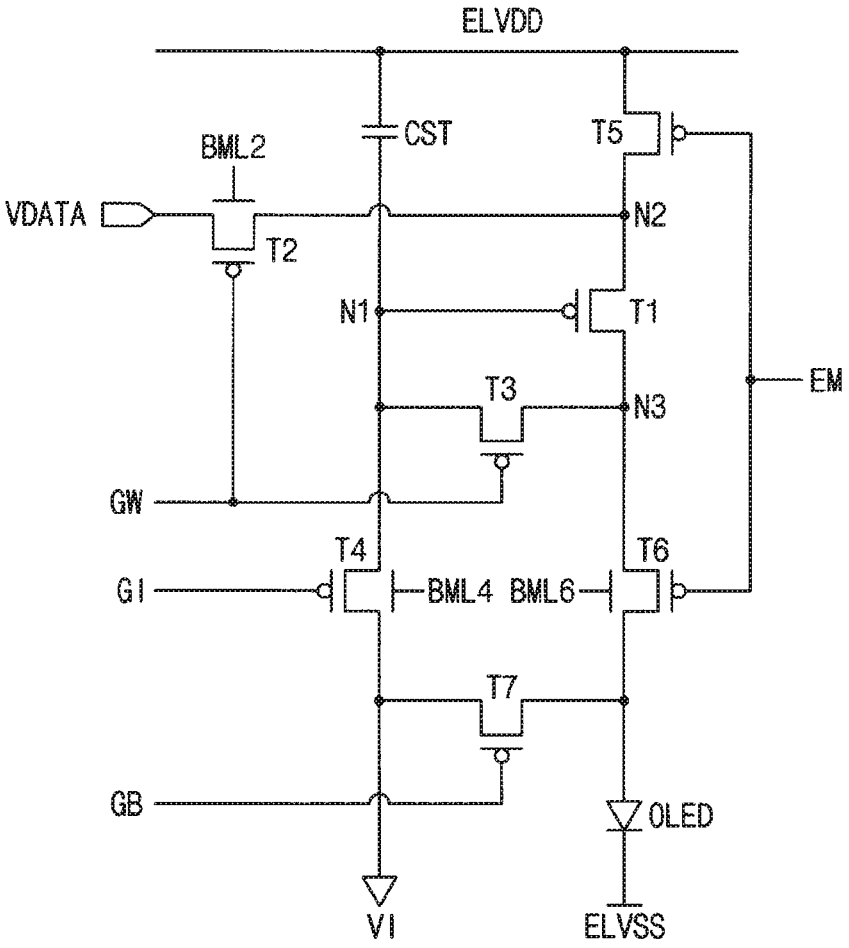
FIG. 22 is a circuit diagram illustrating a pixel of a display panel of a display apparatus according to an exemplary embodiment of the present inventive concept.

FIG. 22 is a circuit diagram illustrating a pixel of a display panel of a display apparatus according to an exemplary embodiment of the present inventive concept.

A display apparatus and a method of driving the display apparatus according to an exemplary embodiment described with reference to FIG. 22 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 22, the display apparatus may include a flexible display panel. The display apparatus may be a foldable display apparatus.

In an exemplary embodiment according to FIGS. 1 to 3, 5 to 9B and 22, the second pixel switching element T2, the fourth pixel switching element T4 and the sixth pixel switching element T6 of the pixel may include the back gate electrodes BML2, BML4 and BML6.

Figure 23:
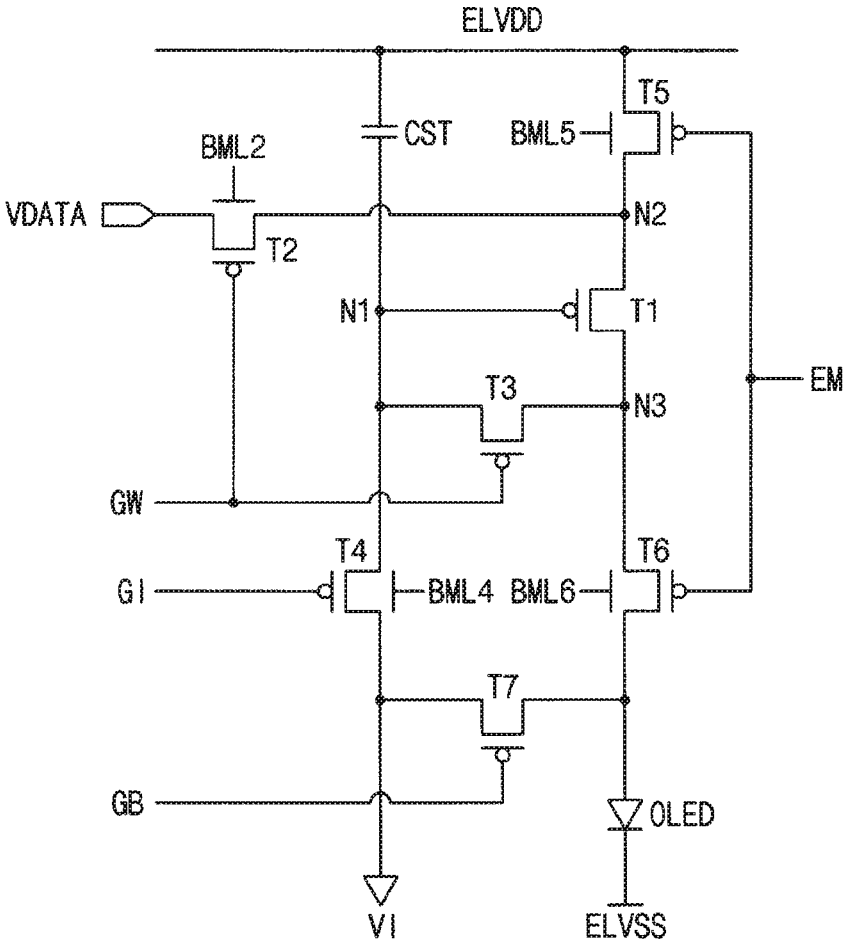
FIG. 23 is a circuit diagram illustrating a pixel of a display panel of a display apparatus according to an exemplary embodiment of the present inventive concept.

FIG. 23 is a circuit diagram illustrating a pixel of a display panel of a display apparatus according to an exemplary embodiment of the present inventive concept.

A display apparatus and a method of driving the display apparatus according to an exemplary embodiment described with reference to FIG. 23 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 23, the display apparatus may include a flexible display panel. The display apparatus may be a foldable display apparatus.

In an exemplary embodiment according to FIGS. 1 to 3, 5 to 9B and 23, the second pixel switching element T2, the fourth pixel switching element T4, the fifth pixel switching element T5 and the sixth pixel switching element T6 of the pixel may include the back gate electrodes BML2, BML4, BML5 and BML6.

Figure 24:
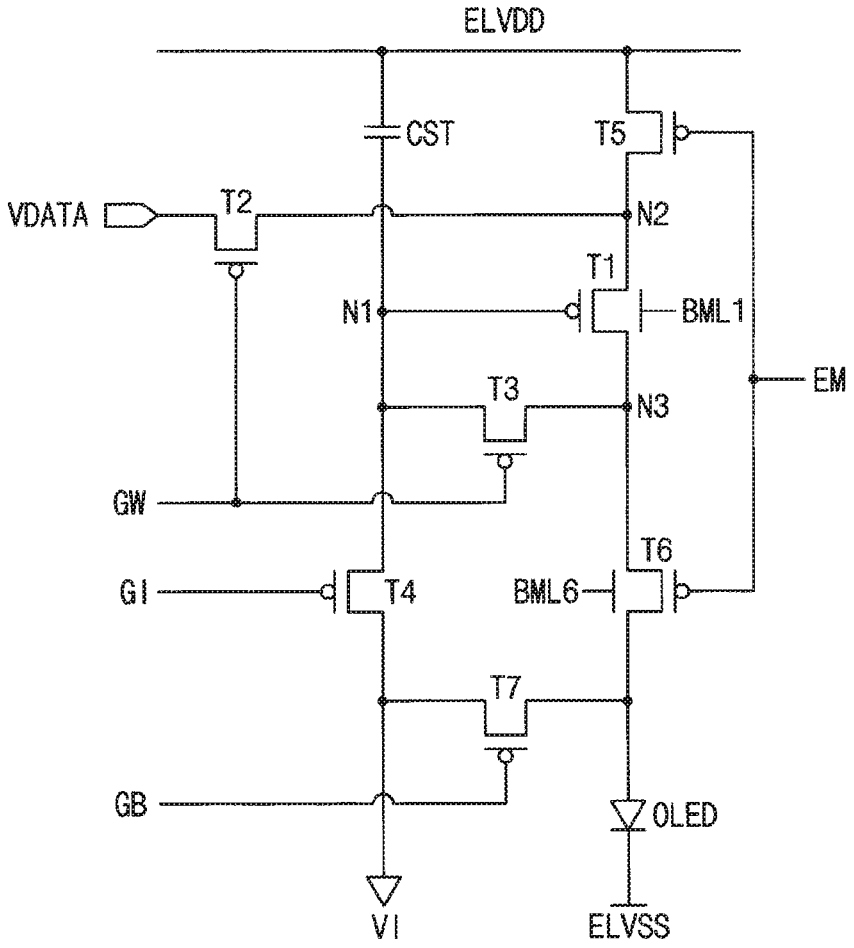
FIG. 24 is a circuit diagram illustrating a pixel of a display panel of a display apparatus according to an exemplary embodiment of the present inventive concept.

FIG. 24 is a circuit diagram illustrating a pixel of a display panel of a display apparatus according to an exemplary embodiment of the present inventive concept.

A display apparatus and a method of driving the display apparatus according to an exemplary embodiment described with reference to FIG. 24 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 24, the display apparatus may include a flexible display panel. The display apparatus may be a foldable display apparatus.

In an exemplary embodiment according to FIGS. 1 to 3, 5 to 9B and 24, the first pixel switching element T1 and the sixth pixel switching element T6 of the pixel may include the back gate electrodes BML1 and BML6.

Figure 25:
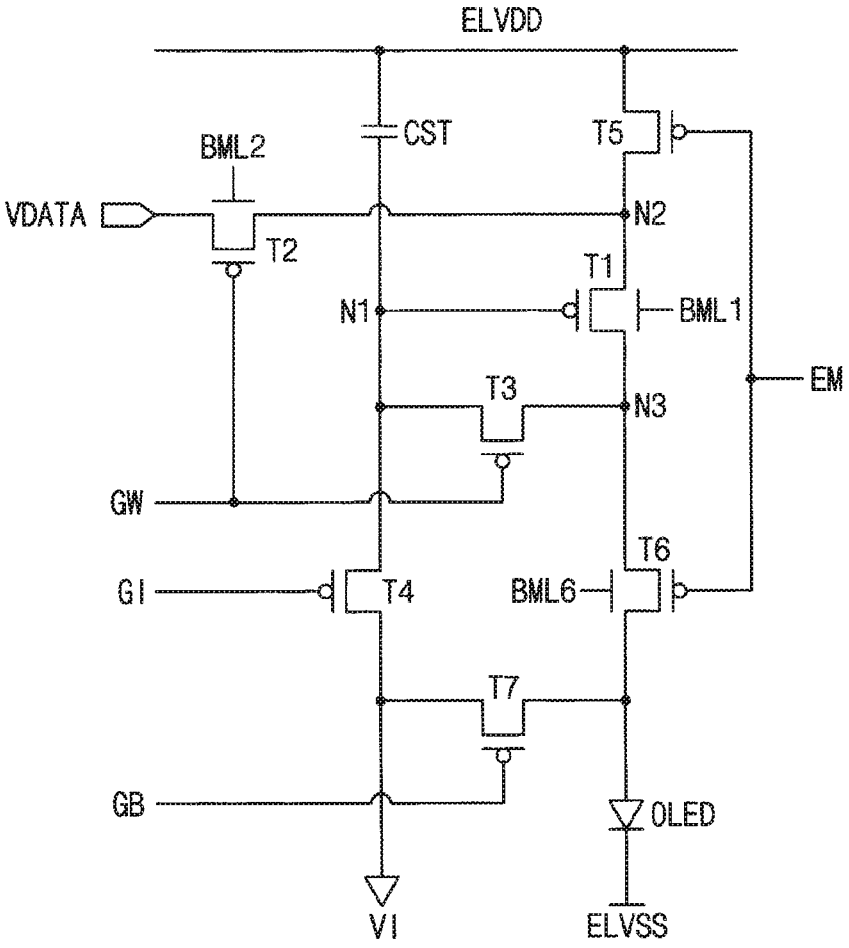
FIG. 25 is a circuit diagram illustrating a pixel of a display panel of a display apparatus according to an exemplary embodiment of the present inventive concept.

FIG. 25 is a circuit diagram illustrating a pixel of a display panel of a display apparatus according to an exemplary embodiment of the present inventive concept.

A display apparatus and a method of driving the display apparatus according to an exemplary embodiment described with reference to FIG. 25 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 25, the display apparatus may include a flexible display panel. The display apparatus may be a foldable display apparatus.

In an exemplary embodiment according to FIGS. 1 to 3, 5 to 9B and 25, the first pixel switching element T1, the second pixel switching element T2 and the sixth pixel switching element T6 of the pixel may include the back gate electrodes BML1, BML2 and BML6.

Figure 26:
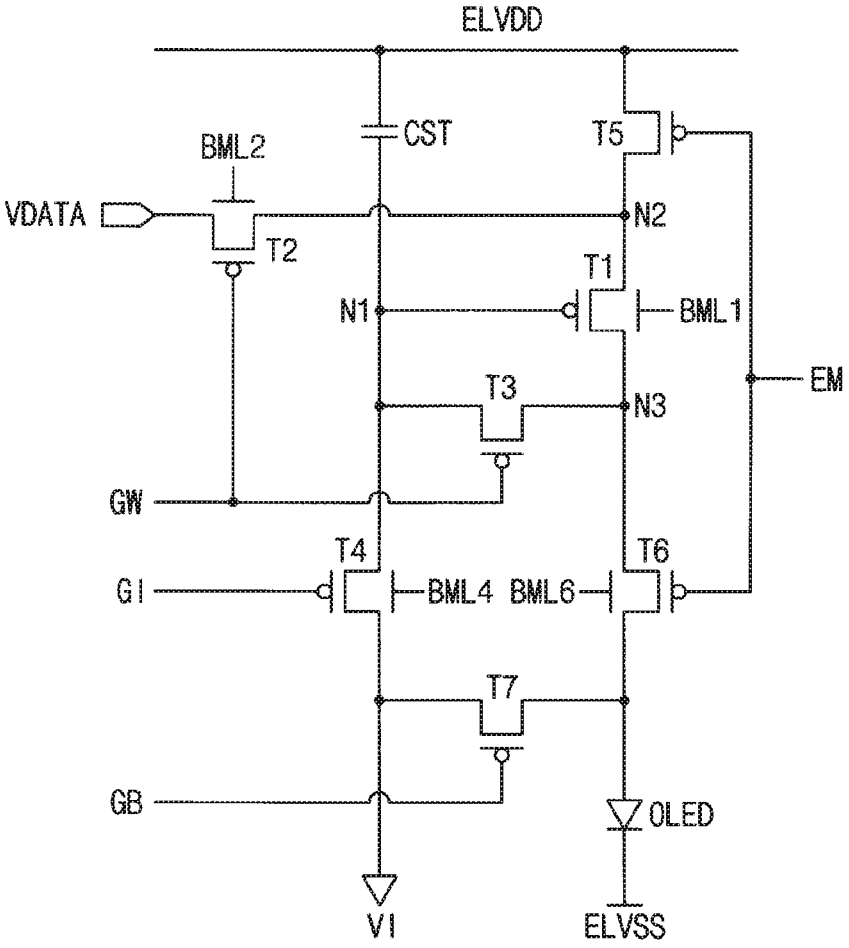
FIG. 26 is a circuit diagram illustrating a pixel of a display panel of a display apparatus according to an exemplary embodiment of the present inventive concept.

FIG. 26 is a circuit diagram illustrating a pixel of a display panel of a display apparatus according to an exemplary embodiment of the present inventive concept.

A display apparatus and a method of driving the display apparatus according to an exemplary embodiment described with reference to FIG. 26 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 26, the display apparatus may include a flexible display panel. The display apparatus may be a foldable display apparatus.

In an exemplary embodiment according to FIGS. 1 to 3, 5 to 9B and 26, the first pixel switching element T1, the second pixel switching element T2, the fourth pixel switching element T4 and the sixth pixel switching element T6 of the pixel may include the back gate electrodes BML1, BML2, BML4 and BML6.

Figure 27:
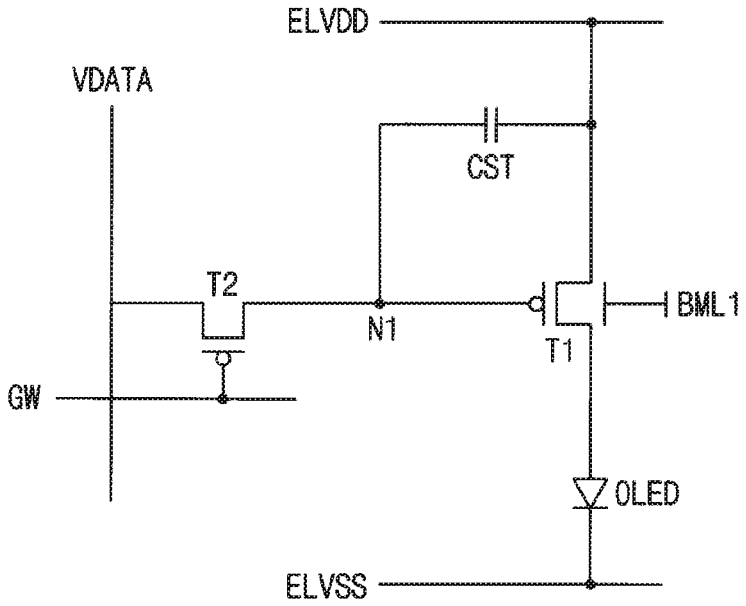
FIG. 27 is a circuit diagram illustrating a pixel of a display panel of a display apparatus according to an exemplary embodiment of the present inventive concept.

FIG. 27 is a circuit diagram illustrating a pixel of a display panel of a display apparatus according to an exemplary embodiment of the present inventive concept.

A display apparatus and a method of driving the display apparatus according to an exemplary embodiment described with reference to FIG. 27 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 27, the display apparatus may include a flexible display panel. The display apparatus may be a foldable display apparatus.

At least one of the pixels of the display panel 100 includes a first pixel switching element T1 including a control electrode connected to a first node N1, an input electrode receiving a high power voltage ELVDD, an output electrode connected to an anode electrode of an organic light emitting element OLED, a second pixel switching element T2 including a control electrode receiving the gate signal GW, an input electrode receiving the data voltage VDATA and an output electrode connected to the first node N1, a storage capacitor CST including a first electrode receiving the high power voltage ELVDD and a second electrode connected to the first node N1 and the organic light emitting element OLED including the anode electrode and a cathode electrode receiving a low power voltage ELVSS.

In an exemplary embodiment described with reference to FIG. 27, the first pixel switching element T1 may include the back gate electrode BML1.

When the pixel off voltage VPOFF is applied to the back gate electrode BML1 of the first pixel switching element T1 of FIG. 27, the first pixel switching element T1 is turned off. When the first pixel switching element T1 is turned off, a current path generated through the first pixel switching element T1 and the organic light emitting element OLED is cut so that the pixel does not emit light.

According to an exemplary embodiment described with reference to FIG. 27, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

Figure 28:
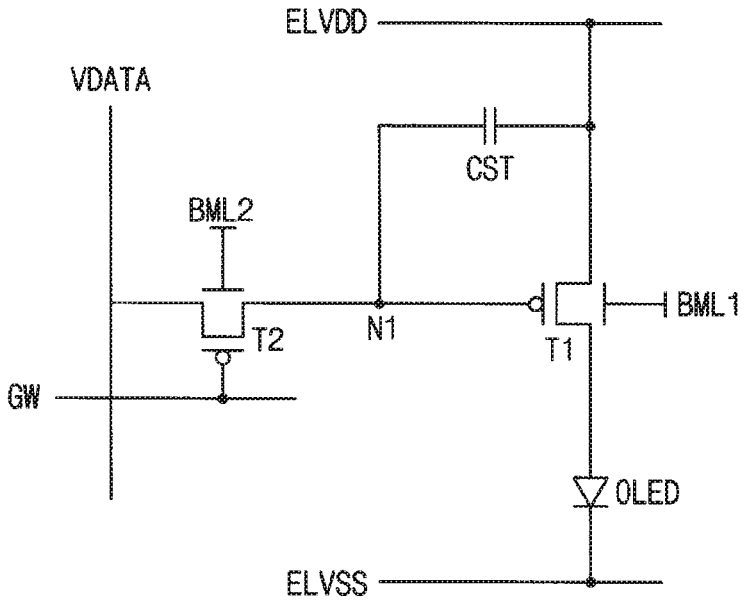
FIG. 28 is a circuit diagram illustrating a pixel of a display panel of a display apparatus according to an exemplary embodiment of the present inventive concept.

FIG. 28 is a circuit diagram illustrating a pixel of a display panel of a display apparatus according to an exemplary embodiment of the present inventive concept.

A display apparatus and a method of driving the display apparatus according to an exemplary embodiment described with reference to FIG. 28 is substantially the same as the display apparatus and the method of driving the display apparatus of an exemplary embodiment described with reference to FIGS. 1 to 9B, except for the circuit diagram of the pixel of the display panel. Thus, for convenience of explanation, the same reference numerals will be used to refer to the same or like parts as those described above with reference to FIGS. 1 to 9B, and any repetitive explanation concerning the above elements will be omitted.

Referring to FIGS. 1 to 3, 5 to 9B and 28, the display apparatus may include a flexible display panel. The display apparatus may be a foldable display apparatus.

At least one of the pixels of the display panel 100 includes a first pixel switching element T1, a second pixel switching element T2, a storage capacitor CST and an organic light emitting element OLED.

In an exemplary embodiment described with reference to FIG. 28, the first pixel switching element T1 and the second pixel switching element T2 may include the back gate electrodes BML1 and BML2.

When the pixel off voltage VPOFF is applied to the back gate electrodes BML1 and BML2 of the first and second pixel switching elements T1 and T2 of FIG. 28, the first and second pixel switching elements T1 and T2 are turned off. When the first and second pixel switching elements T1 and T2 are turned off, a current path generated through the first pixel switching element T1 and the organic light emitting element OLED is cut so that the pixel does not emit light.

According to an exemplary embodiment described with reference to FIG. 28, the independent back gate signals BS1 and BS2 are applied to the first back gate electrodes disposed in the first display area DA1 and the second back gate electrodes disposed in the second display area DA2 so that the pixels in the inactive area DA2 may be controlled not to emit light. In addition, the gate driver 300 does not output the gate signal to the inactive area DA2, the data driver 500 does not output the data voltage to the inactive area DA2 and the emission driver 600 does not output the emission signal to the inactive area DA2 in a folded state of the display panel. Thus, the power consumption of the display apparatus may be reduced.

According to exemplary embodiments of the present inventive concept as described above, the power consumption of the foldable display apparatus may be reduced.

While the present inventive concept has been particularly shown and described with reference to the exemplary embodiments thereof, it will be understood by those of ordinary skill in the art that various changes in form and detail may be made therein without departing from the spirit and scope of the present inventive concept as defined by the following claims.

What is claimed is:

1. A display apparatus, comprising:

a display panel comprising a first display area, a second display area, a first back gate signal applying line connected to at least one back gate electrode of at least one of a plurality of pixels in the first display area, and a second back gate signal applying line connected to at least one back gate electrode of at least one of a plurality of pixels in the second display area;

a power voltage generator configured to output a first back gate signal to the first back gate signal applying line and a second back gate signal to the second back gate signal applying line;

a gate driver configured to output a gate signal to the display panel; and a data driver configured to output a data voltage to the display panel, wherein the first display area is configured to display an image and the second display area is configured not to display an image in a partial driving mode, and wherein the first back gate signal is different from the second back gate signal in the partial driving mode.

2. The display apparatus of claim 1, wherein the first display area and the second display area are configured to display an image in a normal driving mode, and wherein the first back gate signal is substantially the same as the second back gate signal in the normal driving mode.

3. The display apparatus of claim 1, wherein the second back gate signal is greater than the first back gate signal in the partial driving mode.

4. The display apparatus of claim 1, wherein at least one of the pixels of the display panel comprises:

a first pixel switching element comprising a control electrode connected to a first node, an input electrode connected to a second node and an output electrode connected to a third node;

a second pixel switching element comprising a control electrode configured to receive a data write gate signal, an input electrode configured to receive the data voltage and an output electrode connected to the second node;

a third pixel switching element comprising a control electrode configured to receive the data write gate signal, an input electrode connected to the first node and an output electrode connected to the third node;

a fourth pixel switching element comprising a control electrode configured to receive a data initialization gate signal, an input electrode configured to receive an initialization voltage and an output electrode connected to the first node;

a fifth pixel switching element comprising a control electrode configured to receive an emission signal, an input electrode configured to receive a high power voltage and an output electrode connected to the second node;

a sixth pixel switching element comprising a control electrode configured to receive the emission signal, an input electrode connected to the third node and an output electrode connected to an anode electrode of an organic light emitting element;

a seventh pixel switching element comprising a control electrode configured to receive an organic light emitting element initialization gate signal, an input electrode configured to receive the initialization voltage and an output electrode connected to the anode electrode of the organic light emitting element;

a storage capacitor comprising a first electrode configured to receive the high power voltage and a second electrode connected to the first node; and the organic light emitting element comprising the anode electrode and a cathode electrode configured to receive a low power voltage.

5. The display apparatus of claim 4, wherein the first pixel switching element further comprises a back gate electrode configured to receive the first back gate signal or the second back gate signal.

6. The display apparatus of claim 4, wherein the sixth pixel switching element further comprises a back gate electrode configured to receive the first back gate signal or the second back gate signal.

7. The display apparatus of claim 4, wherein the first pixel switching element further comprises a first back gate electrode configured to receive the first back gate signal or the second back gate signal, and wherein the sixth pixel switching element further comprises a second back gate electrode configured to receive the first back gate signal or the second back gate signal.

8. The display apparatus of claim 1, wherein at least one of the pixels of the display panel comprises:

a first pixel switching element comprising a control electrode connected to a first node, an input electrode configured to receive a high power voltage and an output electrode connected to an anode electrode of an organic light emitting element;

a second pixel switching element comprising a control electrode configured to receive the gate signal, an input electrode configured to receive the data voltage and an output electrode connected to the first node;

a storage capacitor comprising a first electrode configured to receive the high power voltage and a second electrode connected to the first node; and the organic light emitting element comprising the anode electrode and a cathode electrode configured to receive a low power voltage.

9. The display apparatus of claim 8, wherein the first pixel switching element further comprises a first back gate electrode configured to receive the first back gate signal or the second back gate signal.

10. The display apparatus of claim 9, wherein the second pixel switching element further comprises a second back gate electrode configured to receive the first back gate signal or the second back gate signal.

11. A display apparatus, comprising:

a display panel comprising a first display area, a second display area, a first back gate signal applying line connected to at least one back gate electrode of at least one of a plurality of pixels in the first display area, and a second back gate signal applying line connected to at least one back gate electrode of at least one of a plurality of pixels in the second display area;

a power voltage generator configured to output a first back gate signal to the first back gate signal applying line and a second back gate signal to the second back gate signal applying line;

a gate driver configured to output a gate signal to the display panel;

a data driver configured to output a data voltage to the display panel; and an emission driver configured to output an emission signal to the display panel, wherein the second back gate signal is configured to increase from a normal level to an inactive level greater than the normal level when the display panel is folded, and wherein at least one of the gate driver, the data driver and the emission driver is configured not to output a driving signal to the second display area when the display panel is folded.

12. The display apparatus of claim 11, wherein a carry signal is not transmitted to a portion of the gate driver corresponding to the second display area so that the gate driver is configured not to output the gate signal to the second display area when the display panel is folded.

13. The display apparatus of claim 11, wherein an output buffer of the data driver is configured to be deactivated when outputting the data voltage to the second display area so that the data driver is configured not to output the data voltage to the second display area when the display panel is folded.

14. The display apparatus of claim 11, wherein the data driver is configured to output a black data voltage to the second display area when the display panel is folded.

15. The display apparatus of claim 11, wherein the second back gate signal is configured to decrease from the inactive level to the normal level when the display panel changes from a folded state to an unfolded state.

16. The display apparatus of claim 15, wherein the data driver is configured to temporally output a black data voltage to the second display area when the display panel changes from the folded state to the unfolded state.

17. A method of driving a display apparatus, the method comprising:

outputting a first back gate signal to a first back gate signal applying line connected to at least one back gate electrode of at least one of a plurality of pixels in a first display area of a display panel;

outputting a second back gate signal to a second back gate signal applying line connected to at least one back gate electrode of at least one of a plurality of pixels in a second display area of the display panel;

outputting a gate signal to the display panel; and outputting a data voltage to the display panel, wherein the first display area is configured to display an image and the second display area is configured not to display an image in a partial driving mode, and wherein the first back gate signal is different from the second back gate signal in the partial driving mode.

18. The method of claim 17, wherein the first display area and the second display area are configured to display an image in a normal driving mode, wherein the first back gate signal is substantially the same as the second back gate signal in the normal driving mode.

19. The method of claim 17, wherein the second back gate signal is configured to increase from a normal level to an inactive level greater than the normal level when the display panel is folded, wherein at least one of a gate driver, a data driver and an emission driver is configured not to output a driving signal to the second display area when the display panel is folded, and wherein the second back gate signal is configured to decrease from the inactive level to the normal level when the display panel changes from a folded state to an unfolded state.

* * * * *